US008326185B2

(12) United States Patent
Asanuma et al.

(10) Patent No.: US 8,326,185 B2
(45) Date of Patent: Dec. 4, 2012

(54) DEVELOPING DEVICE HAVING STIRRING PORTION WITH A SWEEPING EDGE TO CARRY DEVELOPER

(75) Inventors: Naoya Asanuma, Susono (JP); Yoshiyuki Batori, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 683 days.

(21) Appl. No.: 12/361,956

(22) Filed: Jan. 29, 2009

(65) Prior Publication Data

US 2010/0028050 A1 Feb. 4, 2010

(30) Foreign Application Priority Data

Jul. 31, 2008 (JP) ..... 2008-198425

(51) Int. Cl.
*G03G 15/08* (2006.01)

(52) U.S. Cl. ..... 399/254; 399/256; 399/258; 399/263

(58) Field of Classification Search ..... 399/254, 399/256, 258, 263
See application file for complete search history.

(56) References Cited

U.S. PATENT DOCUMENTS

| | | | | |
|---|---|---|---|---|
| 7,558,514 | B2 | 7/2009 | Yamamura | |
| 2005/0249519 | A1 * | 11/2005 | Chadez | 399/106 |
| 2007/0053722 | A1 * | 3/2007 | Sato et al. | 399/258 |
| 2007/0280739 | A1 * | 12/2007 | Tanaka | 399/254 |
| 2008/0199222 | A1 * | 8/2008 | Nakajima | 399/254 |

FOREIGN PATENT DOCUMENTS

| | | |
|---|---|---|
| CN | 1841230 | 10/2006 |
| JP | 2000-330365 | 11/2000 |
| JP | 2001-13771 | 1/2001 |
| JP | 2001-42621 | 2/2001 |
| JP | 2002-229316 | 8/2002 |
| JP | 2005-91791 | 4/2005 |
| JP | 2006-84490 | 3/2006 |
| JP | 2006-301387 | 11/2006 |

OTHER PUBLICATIONS

Office Action in Chinese Patent Application No. 20090127908.8, dated Jan. 14, 2011, with English translation.
Office Action in Japanese Patent Application No. 2008-198425, mailed Mar. 24, 2009 (with excerpt English translation).

* cited by examiner

*Primary Examiner* — Ryan Walsh
(74) *Attorney, Agent, or Firm* — Fitzpatrick, Cella, Harper & Scinto

(57) ABSTRACT

A developing device for an electrophotographic image forming apparatus includes a developing roller of a developing portion for developing an electrostatic latent image on an electrophotographic photosensitive drum, a developer accommodator, a supply opening, between the developing portion and the accommodator, and a stirring member including a support rotatably provided on the accommodator and a stirrer on the support. The stirrer's length is longer than the opening's length in a longitudinal direction of a mount mounted to the support and the length of the stirrer's end portion is shorter than the supply opening's length. When the stirrer is rotated, an end thereof enters the opening to feed the developer from the accommodator through the opening to the developing portion and then through the supply opening back to the developer accommodating portion.

15 Claims, 14 Drawing Sheets

DEVELOPING DEVICE HAVING STIRRING PORTION WITH A SWEEPING EDGE TO CARRY DEVELOPER

FIELD OF THE INVENTION AND RELATED ART

The present invention relates to a developing apparatus used by an electrophotographic image forming apparatus. It also relates to an electrophotographic image forming apparatus in which a process cartridge is removably mountable.

A "process cartridge" means a cartridge in which an electrophotographic photosensitive drum, and at least one among the processing means, more specifically, a developing means, a cleaning means, and a charging means, which act one the electrophotographic photosensitive drum, are integrally disposed. A "process cartridge" is removably mounted into the main assembly of an electrophotographic image forming apparatus by a user.

An "image forming apparatus" is an apparatus which forms an image on recording medium with the use of an electrophotographic image forming method. Some of the examples of an electrophotographic image forming apparatus are an electrophotographic copying machine, an electrophotographic printer (LED printer, laser beam printer, etc.), a facsimile apparatus, a wordprocessor, etc.

The abovementioned recording medium is any medium on which an image is formable. Some examples of the recording medium are a sheet of ordinary paper, a sheet for an OHP, etc.

The "main assembly" of an electrophotographic image forming apparatus is what remains after the removable of a process cartridge or process cartridges from the electrophotographic image forming apparatus.

In the field of an electrophotographic image forming apparatus, it has been a common practice to use a process cartridge system, which integrally disposes an electrophotographic photosensitive drum and one or more processing means (which act on electrophotographic photosensitive drum), in a cartridge which is removably mountable in the main assembly of an electrophotographic image forming apparatus.

A process cartridge system makes it possible for a user to maintain an image forming apparatus himself or herself, that is, without relying on a service person. Thus, it can drastically improve an image forming apparatus in operational efficiency in terms of maintenance.

Regarding a developing apparatus disposed in a process cartridge such as those described above, a developing apparatus having a developer storage portion, a development roller, a development portion, and a blade, has been put to practical use. The developer storage portion (which hereafter may be referred to as toner chamber) is a portion in which developer is stored. A development station (which hereafter may be referred to as development chamber), is a portion in which toner is supplied to a development roller.

Japanese Laid-open Patent Application 2000-330365 discloses a process cartridge which has a stirring member made up of a stirring portion and a stirring portion supporting portion. The stirring portion supporting portion is rotatably attached to the frame of the process cartridge. The stirring portion is firmly attached to the supporting portion. Further, the process cartridge is structured so that as the supporting portion is rotated, the toner in the toner chamber is conveyed to the development chamber by the stirring portion.

SUMMARY OF THE INVENTION

It is an object of the present invention to provide a developing apparatus and an electrophotographic image forming apparatus in which the developer stored in the developer storage portion can be satisfactorily moved in a circulatory manner between the developer storage portion and development portion.

It is another object of the present invention to provide a developing apparatus and an image forming apparatus in which not only is it possible to satisfactorily convey the developer in the developer storage portion, to the development portion, but also, to satisfactorily return the developer from the development portion to the developer storage portion.

It is a further object of the present invention to provide a developing apparatus and an electrophotographic image forming apparatus in which not only is it possible to satisfactorily convey the developer from the developer storage portion, deeper into the development portion, but also, to satisfactory return the developer from the developer portion, deeper into the development storage portion, than any of the prior arts.

According to an aspect of the present invention, there is provided a developing device for an electrophotographic image forming apparatus, said developing device comprising a developing roller for developing an electrostatic latent image formed on said electrophotographic photosensitive drum; a developing portion in which said developing roller is provided; a developer accommodating portion for accommodating the developer to be used for development of the electrostatic latent image by said developing roller; a supply opening, provided between said developing portion and said developer accommodating portion, for supplying the developer from said developer accommodating portion; and a stirring member including a supporting portion rotatably provided on said developer accommodating portion, and a stirring portion provided on said supporting portion, wherein a stirring portion has a length measured in a longitudinal direction of a mounting portion mounted to said supporting portion, which is longer than a length of said supply opening in the longitudinal direction, and wherein said stirring portion has an end portion having a length which is shorter than the length of said supply opening, wherein when said stirring member is rotated, an end of said stirring portion enters said supply opening by a rotation toward said supply opening to feed the developer from said developer accommodating portion through said supply opening to said developing portion, and wherein the developer thus fed through said supply opening is fed said developer accommodating portion.

According to another aspect of the present invention, there is provided an electrophotographic image forming apparatus to which a process cartridge is detachably mountable, said apparatus comprising i) a process cartridge including, an electrophotographic photosensitive drum, a developing roller for developing an electrostatic latent image formed on said electrophotographic photosensitive drum, a developing portion in which said developing roller is provided, a developer accommodating portion for accommodating the developer to be used for development of the electrostatic latent image by said developing roller, a supply opening, provided between said developing portion and said developer accommodating portion, for supplying the developer from said developer accommodating portion, and a stirring member including a supporting portion rotatably provided on said developer accommodating portion, and a stirring portion provided on said supporting portion, wherein a stirring portion has a length measured in a longitudinal direction of a mounting portion mounted to said supporting portion, which is longer than a length of said supply opening in the longitudinal direction, and wherein said stirring portion has an end portion having a length which is shorter than the length of said supply opening, wherein when said stirring member is rotated, an end of said stirring portion enters said supply opening by a rotation toward said supply opening to feed the developer from said developer accommodating portion through said supply opening to said developing portion, and wherein the developer thus fed through said supply opening is fed said developer accommodating portion; and ii) a transfer roller for transferring a developed image formed on said electrophotographic photosensitive drum onto a recording material; feeding means for feeding the recording material.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiment of the present invention will be described with reference to an electrophotographic image forming apparatus, and a process cartridge used by the image forming apparatus. The preferred embodiment will be described assuming the process cartridge is removably mountable in the main assembly of the electrophotographic image forming apparatus. It is also assumed that the developing apparatus and electrophotographic photosensitive drum are integrally disposed in the process cartridge, which is removably mountable in the main assembly of the electrophotographic image forming apparatus.

However, the preferred embodiment is not intended to limit the present invention in scope. That is, the present invention is also applicable to a built-in developing apparatus of the main assembly of an electrophotographic image forming apparatus, and a developing apparatus (so-called development cartridge) designed to be removably mountable in the apparatus main assembly.

(Overall Structure)

Figure 1:
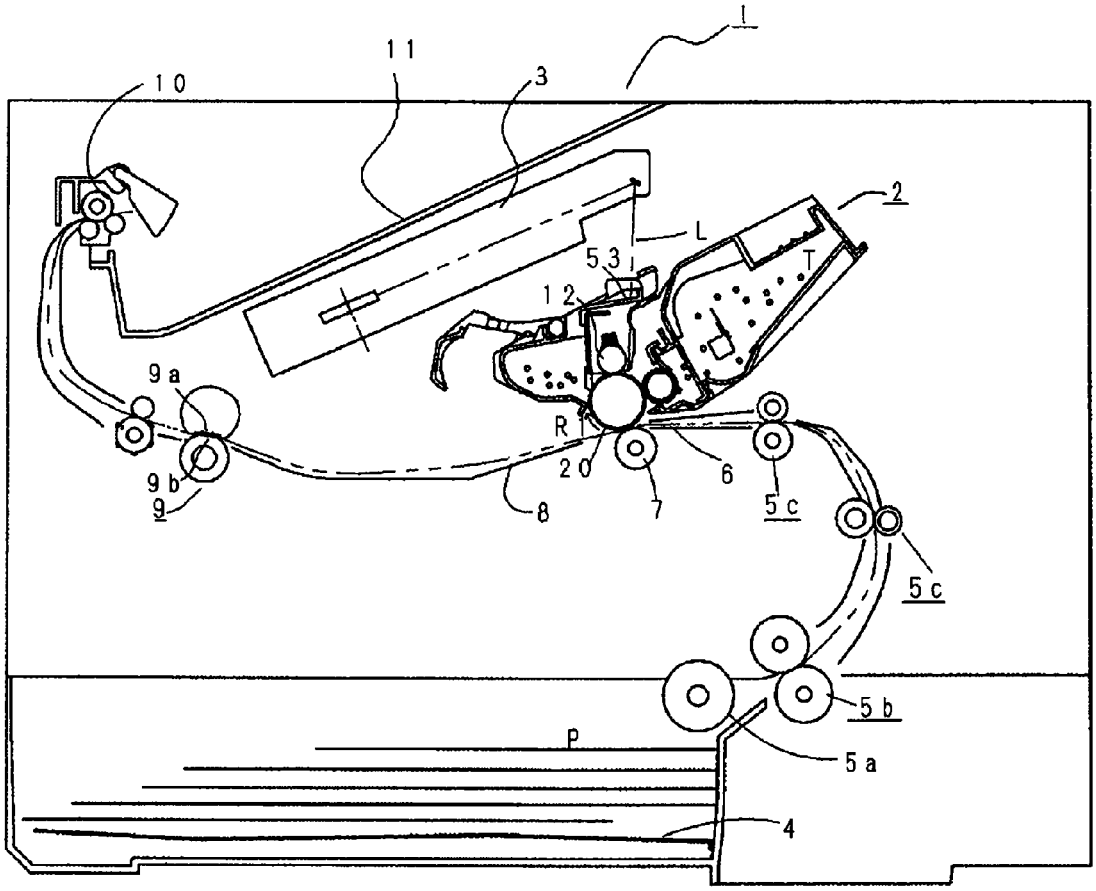
FIG. 1 is a sectional view of the combination of the main assembly of the image forming apparatus, and process cartridge in the main assembly, in the preferred embodiment of the present invention.
Figure 2:
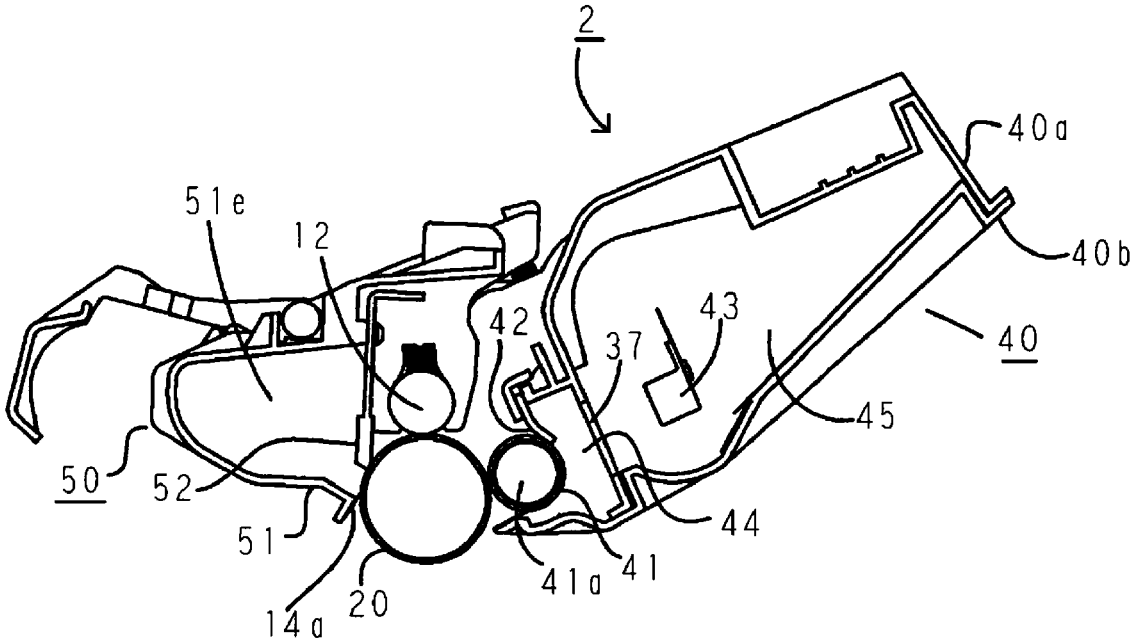
FIG. 2 is an enlarged sectional view of the process cartridge in the preferred embodiment.

FIG. 1 is a sectional view of the combination of the main assembly 1 of the image forming apparatus (which hereafter may be referred to simply as apparatus main assembly 1), and process cartridge 2 (which hereafter may be referred to simply as cartridge 2) in the main assembly, in the preferred embodiment of the present invention. FIG. 2 is an enlarged sectional view of the cartridge 2. Next, referring to FIGS. 1 and 2, the general structure of the image forming apparatus in this embodiment, and the image formation process carried out by the image forming apparatus, will be described.

This image forming apparatus is a laser beam printer structured so that the cartridge 2 is removably mountable in the apparatus main assembly 1. Further, the image forming apparatus is structured so that when the cartridge 2 is in its image forming position in the main assembly 1, the exposing apparatus 3 is on the top side of the cartridge 2, and also, a sheet tray 4, in which sheets of recording medium P (which hereafter may be referred to simply as sheet P), is on the bottom side of the cartridge 2. Further, the apparatus main assembly 1 is provided with a pickup roller 5*a*, a pair of sheet feeding-and-conveying rollers 5*b*, two pairs of sheet conveying rollers 5*c*, a sheet transfer guide 6, a transfer charge roller 7, a sheet conveyance guide 8, a fixing apparatus 9, a pair of sheet discharging rollers 10, a delivery tray 11, etc. In terms of the direction in which the sheet P is conveyed through the apparatus main assembly 1, they are arranged in the order in which they are listed. The charge roller 7 is a roller for transferring an image formed of developer on a photosensitive drum 10, onto the sheet P. Incidentally, the pickup roller 5*a*, sheet feeding-and-conveying rollers 5*b*, sheet conveying rollers 5*c*, and sheet discharging rollers 10, etc., make up a conveying means for conveying the sheet P.

(Description of Image Formation Process)

Next, the image formation process of this image forming apparatus will be described.

First, a print start signal is to be inputted. As a print start signal is inputted, the electrophotographic photosensitive drum 20 (which hereafter will be referred to simply as drum 20) begins to be rotationally driven in the direction indicated by an arrow mark R1 at a preset peripheral velocity (process speed). The peripheral surface of the drum 20 is in contact with a charge roller 12. Thus, the peripheral surface of the drum 20 is uniformly charged by the charge roller 12.

Then, a beam of laser light L is outputted from the exposing apparatus 3 while being modulated with picture element signals, which reflect the information regarding the image to be formed. The beam of laser light L is projected into the cartridge 2 through an opening 53, with which the top wall of the cartridge 2 is provided. As the beam of laser light L is projected into the cartridge 2, it scans the charged portion of the peripheral surface of the drum 20. As a result, an electrostatic latent image, which is in accordance with the information regarding the intended image, is formed on the charged portion of the peripheral surface of the drum 20. This electrostatic latent image is developed by developer T (which hereafter may be referred to as toner T), into a visible image, that is, an image formed of toner. The developer T is stored in a developing apparatus unit 40.

To describe in more detail, the charge roller 12, which is a charging means, is in contact with the drum 20, and charges the drum 20. It is rotated by the rotation of the drum 20. The development unit 40 develops the latent image on the drum 20, by supplying the portion of the peripheral surface of the drum 20, which has the latent image, with toner T. The unit 40 has a toner chamber (developer storing portion), a stirring member 43, and a development chamber (latent image developing portion). The unit 40 has also a development roller 41 (developer bearing member), and a development blade 42.

The development chamber 44 (latent image developing portion) is one of the spaces created by partitioning the interior of the process cartridge 2. It is the chamber in which the development roller 41 is located.

The toner T is in a toner chamber 45 (developer storage portion) is sent out to the development chamber 44 by the rotation of the stirring member 43. As the development roller 41, which internally holds a magnetic roller 41 (stationary magnet), is rotated, a layer of frictionally charged toner particles is formed on the peripheral surface of the development roller 41 by a development blade 42. The charged toner particles in this layer of toner are transferred onto the drum 20 in the pattern of the latent image on the drum 20. As a result, a visible image is formed of toner on the peripheral surface of the drum 20. The development blade 42 is a blade for regulating the amount by which the toner is coated on the peripheral surface of the drum 20 per unit area, and also, for frictionally charging the toner. That is, the development roller 41, which is a latent image developing means, develops the electrostatic latent image on the drum 20, with the use of the toner T.

Meanwhile, the sheet P stored in the bottom portion of the apparatus main assembly 1, is fed into the apparatus main assembly 1 from the sheet tray 4 by the pickup roller 5*a*, sheet feeding-and-conveying rollers 5*b*, and sheet conveying rollers 5*c*, in synchronism with the timing with which the beam of laser light L begins to be outputted. Then, the sheet P is conveyed to the transfer portion, that is, the interface between the drum 20 and transfer charge roller 7, by way of the transfer guide 6. Then, the sheet P is conveyed through the transfer portion. As the sheet P is conveyed through the transfer portion, the image formed of toner (which hereafter will be referred to simply as toner image) on the drum 20 is transferred from the drum 20 onto the sheet P as if it were peeled away from the drum 20.

After the transfer of the toner image onto the sheet P, the sheet P is separated from the drum 20, and then, is conveyed to the fixing apparatus 9 along the conveyance guide 8. Then, the sheet P is conveyed through the nip (interface) between a fixation roller 9*a* and a pressure roller 9*b*, of which the fixing apparatus 9 is made up. In this nip, the toner particles, of which the toner image is formed, are subjected to heat and pressure. As a result, the toner image becomes fixed to the sheet P. After the fixation, the sheet P is conveyed to the pair of discharge rollers 10, and then, is discharged into the delivery tray 11 by the pair of discharge rollers 10.

After the transfer of the toner image from the drum 20, the toner particles remaining on the peripheral surface of the drum 20 are removed by a cleaning blade 52. Then, the cleaned portion of the peripheral surface of the drum 20 is used again for the above described image formation process, which begins with the charging step. The toner removed from the drum 20 is stored in a toner chamber 51*e* for the removed toner, which is a part of the latent image formation unit 50.

In the case of the electrophotographic image forming apparatus in this embodiment, the charge roller 12 (charging means), development roller 41 (developing means (developing apparatus)), cleaning blade 52, etc., are the processing means which act on the drum 20.

(Structure of Process Cartridge)

Figure 3:
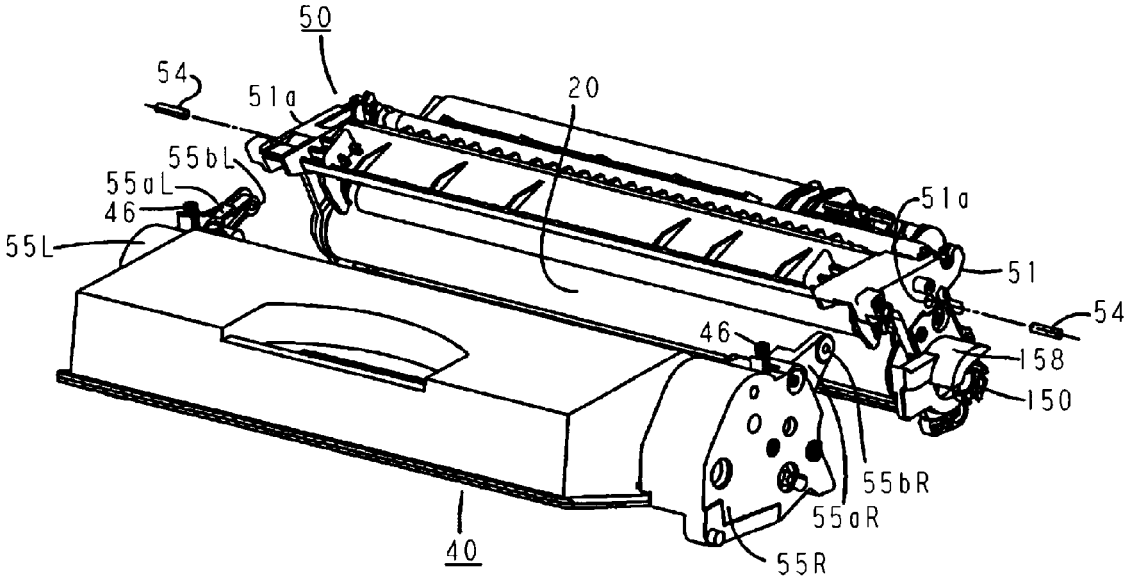
FIG. 3 is a perspective view of the process cartridge, which is for describing the structure of the process cartridge.

FIG. 3 is a perspective view of the cartridge 2, which is for describing the structure of the cartridge 2. Next, the structure of the cartridge 2 will be described with reference to FIGS. 2 and 3.

Referring to FIG. 2, the drum 2, charge roller 12, and cleaning blade 52 are integrally attached to the portion of the frame of the cartridge 2, which supports the drum 20. They make up the latent image formation unit 50. That is, the unit 50 has the drum 20, charge roller 12, and blade 52.

On the other hand, the development unit 40 is made up of the toner chamber 45 for storing toner, toner storage container 40*a*, and lid 40*b*. The wall of the container 40*a* and the lid 40*b* make up the frame of the development unit 40. They are unitized by welding or the like method.

Next, referring to FIG. 3, the units 50 and 40 are connected to each other by a pair of pins 54 (connecting members), making up the cartridge 2, in such a manner that they are allowed to rotationally move relative to each other.

Also referring to FIG. 3, the unit 40 is provided with a pair of lateral members 55 (55L and 55R), which make up the end portions, one for one, of the unit 40 in terms of the lengthwise direction (which is parallel to axial line of development roller 41) of the unit 40. The lateral members 55 (55L and 55R) are provided with arm portions 55*a* (55*a*L and 55*a*R), respectively. The end portion of each of the arm portions 55 is provided with a through hole 55*b* (55*b*L or 55*b*R), which is parallel to the development roller 41. The arm portions 55*a* (55*a*L and 55*a*R) are inserted into a pair of specific portions of the frame 51 of the latent image formation unit 50. On the other hand, the frame 51 of the unit 50 is provided with a pair of holes 51*a* (51*a*L and 51*a*R), through which the pair of connecting members 54 (54L and 54R) are put (left hole 51*a*L is not shown in drawing). The holes 51*a* are positioned in such a manner that as the arm portions 55*a* of the unit 40 are inserted into the abovementioned specific portions of the frame 51 of the unit 50, one for one, they align with the holes 55*a* of the unit 40. After the insertion of the arm portions 55*a* into the abovementioned specific portions of the frame 51 of the unit 50, the connective members 54 (54L and 54R) are put through both the holes 55*b* (55*b*L and 55*b*R) and holes 51*a* (51*a*L and 51*a*R), respectively. With the insertion of the connective members 54, the units 50 and 40 are connected to each other in such a manner that they are allowed to rotationally move relative to each other about the connective members 54.

The cartridge 2 is provided with a pair of compression coil springs 46, which are attached to the base portions of the arm portions 55*a* (55*a*L and 55*a*R), respectively, in such a manner than after the unitization of the two units 40 and 50, the compression coil springs 45 are in contact with the frame 51 of the latent image formation unit 50. Thus, the unit 40 remains pressed downward by the force generated by the resiliency of the springs 46, ensuring that the development roller 41 (FIG. 2) is kept pressed toward the drum 20. Further, the lengthwise end portions of the development roller 41 are fitted with a pair of gap maintaining members (unshown), one for one. Thus, a preset amount of distance is maintained between the development roller 41 and drum 20.

(Latent Image Formation Unit)

Figure 4:
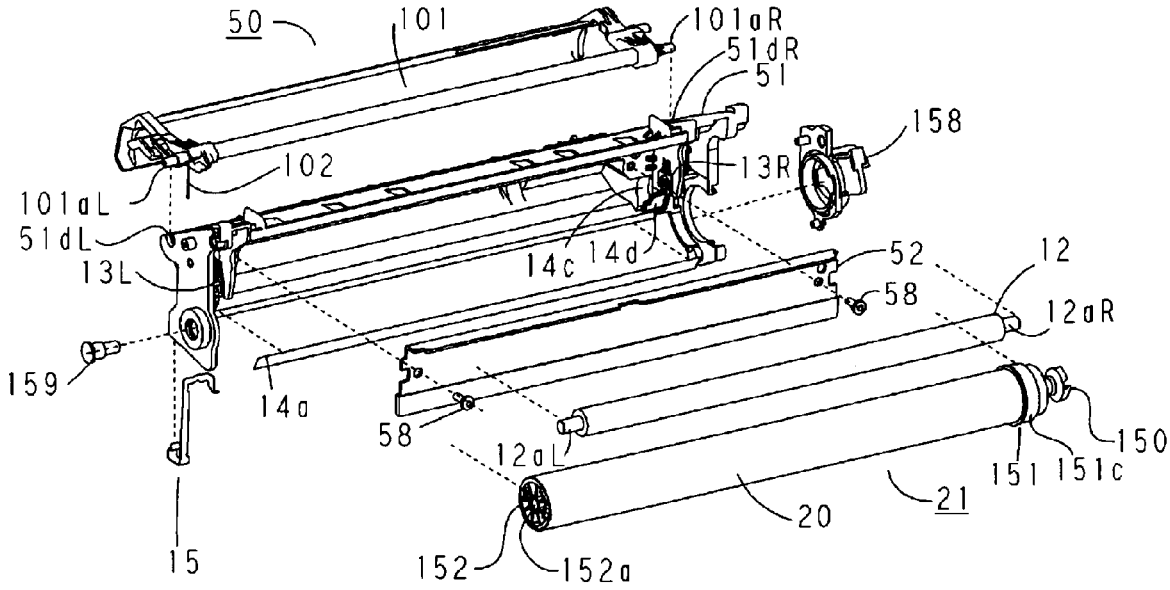
FIG. 4 is an exploded perspective view of the latent image formation unit.

Next, referring to FIGS. 2 and 4, the latent image formation unit 50 will be described. FIG. 4 is a perspective view of the latent image formation unit 50.

The toner image developed by the unit 40 (unit having development roller 41) is transferred onto the sheet P in the transfer portion as described above. The toner remaining on the drum 20 after the transfer is scraped down by the blade 52, and then, is scooped into the aforementioned toner chamber 51*e* by a scooping sheet 14*a*, and remains stored therein.

The blade 52 is a means for removing the toner remaining on the drum 20 after the transfer. In order to prevent the toner from leaking from the toner chamber 51*e*, the latent image formation unit 51 is provided with a first sealing member 14*b* (unshown) and a second sealing member 14*c*, which are securely attached to the predetermined portions of the latent image formation unit 51, with the use of a piece of two-sided adhesive tape or the like. The first and second sealing members 14*b* and 14*c* are for preventing the toner from leaking from the rear side of the corresponding lengthwise ends of the rubber portion of the blade 52.

The blade 52 is firmly attached to a predetermined portion of the latent image formation unit 51, with a pair of small screws 58. The latent image formation unit 51 is also provided with a third sealing member 14*d*, which is a member for preventing the toner from leaking from the lengthwise ends of the rubber portion of the blade 52, and also, for wiping way the substances, such as toner, having adhered to the drum 20. Further, the abovementioned scooping sheet 14*a*, which is a sheet for scooping up the toner removed from the drum 20, is also firmly attached to the latent image formation unit 51 with the use of a piece of two-sided adhesive tape or the like.

Further, the latent image formation unit 51 is fitted with an electrode 15, a pair of charge roller bearings 13 (13L and 13R); the electrode 15 and charge roller bearings 13 are embedded in the frame portion of the latent image formation unit 51. The shaft portions 12*a* (12*a*L and 12*a*R) are fitted in the bearings 13 (13L and 13R), respectively.

The electrophotographic photosensitive member assembly 21 (which hereafter will be referred to simply as drum assembly 21) is provided with a drum flange 151, which makes up one of the lengthwise ends of the drum assembly 21. The drum flange 151 has a rotational force receiving member 150, through which the drum assembly 21 receives rotational force from the apparatus main assembly 1. The method for attaching the drum flange 151 to the drum 20 is crimping, bonding, welding, or the like method. The drum assembly 21 is also provided with a drum flange 152, which is attached to the other lengthwise end of the drum 20, that is, the lengthwise end, from which the drum 20 is not driven. The drum flange 152 is provided with a ground contact, etc., which are integral with the drum flange 152.

The drum assembly 21 is fitted into the latent image formation unit slot in the latent image formation unit frame 51 in such a manner that the drum flange 151 attached to one of the lengthwise end of the drum 20 rotatably fits into the bearing member 158. At the other lengthwise end of the latent image formation unit frame 51, not only is a drum shaft 159 pressed through the drum shaft hole of the latent image formation unit frame 51 so that the drum shaft 159 is firmly attached to the latent image formation unit frame 51, but also, through the hole 152*a* of the drum flange 152 (drum flange on the side from which latent image formation unit is not driven), in such a manner that the drum flange 152 (drum assembly 21) is allowed to rotate about the drum shaft 159.

Further, the unit 50 is provided with a protective member 101 and a pressure application spring 102. The protective member 101 is for shielding the drum 20 from light, and also, for protecting the drum 20. The spring 102 is attached to one 101*a*L of the lengthwise ends of the shaft portion of the protective member 101. The protective member 101 is attached to the latent image formation unit frame 51 (drum supporting frame) by fitting the shaft portion 101*a*L and 101*a*R of the protective member 101 into the bearing portions 51*d* (51*d*L and 51*d*R), respectively, of the drum supporting frame 51, which are roughly U-shaped in cross section.

(Developing Apparatus Unit)

Figure 5:
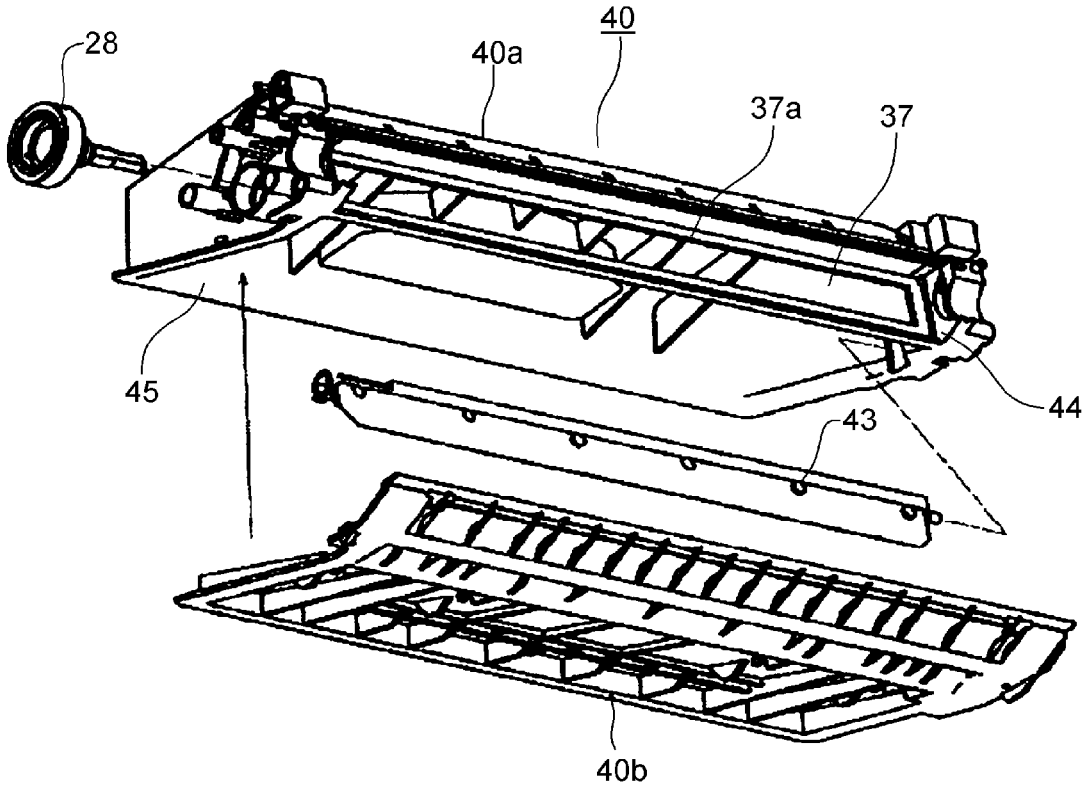
FIG. 5 is an exploded perspective view of the development unit.
Figure 6:
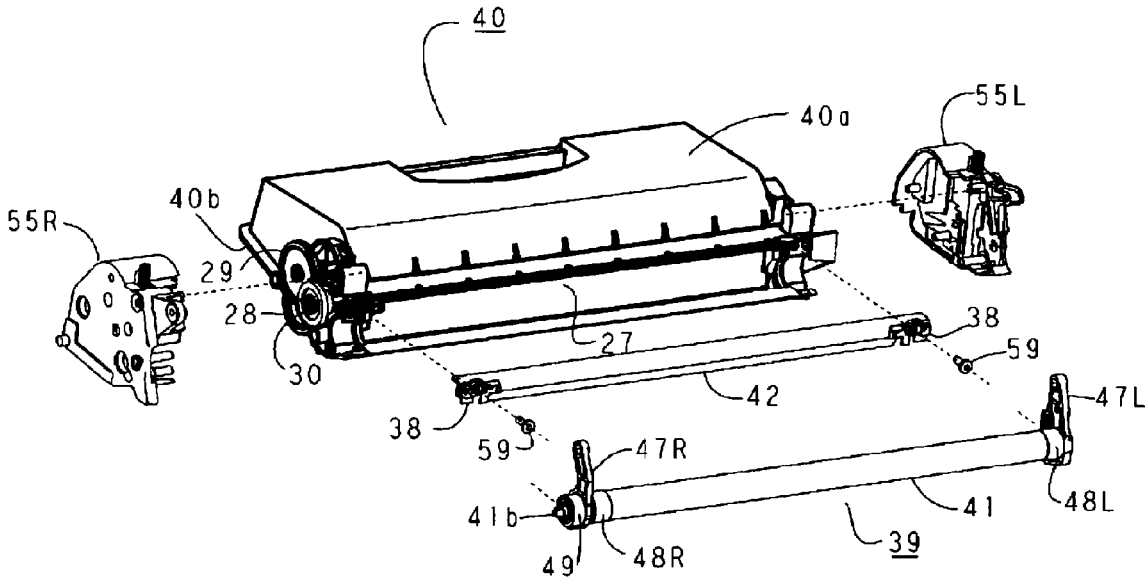
FIG. 6 is also an exploded perspective view of the development unit.

Next, referring to FIGS. 5 and 6, the development unit 40 will be described. FIG. 5 is a perspective view of the toner chamber portion of the development unit 40, which is for describing the structure of the toner chamber 45. FIG. 6 is an exploded perspective view of the development unit 40.

Referring to FIG. 5, the stirring member 43 is in the toner chamber 43. More specifically, one of the lengthwise ends of the stirring member 43 is supported by a helical gear 28 (which hereafter will be referred to as stirring gear) attached to the wall of the toner storage container 40*a* from outside the container 40*a*, whereas the other lengthwise end of the stirring member 43 is directly supported by the wall of the toner storage container 40*a*. The stirring gear 28 rotates by receiving rotational force from the apparatus main assembly 1. The stirring member 43 is rotated by the rotation of the stirring gear 28. As the rotational force is transmitted to the stirring gear 28 from the apparatus main assembly 1, the stirring gear 28 is thrust toward the other lengthwise end of the stirring member 43, and therefore, the stirring member 43 is thrust toward the other lengthwise end of the stirring member 43.

Next, referring to FIG. 6, the development unit 40 has a first gear 30 and a second gear 29, which are rotatably attached to the toner storage container 40*a*. The first and second gears 30 and 29 are in mesh with each other. Thus as the first gear 30 is rotated, the rotational force (driving force) is transmitted from the first gear 30 to the second gear 29, and then, from the second gear 29 to the stirring gear 28.

The toner storage container 40*a*, the walls of which function as the frame portion of the development unit 40 having the toner chamber 45 and development chamber 44, integrated with the lid 40*b* by ultrasonic welding as described above.

There is a toner delivery hole 37 between the development chamber 44 (FIG. 2) and toner chamber 45. The toner delivery hole 37 is the hole for moving the toner in the toner chamber 45, from the toner chamber 45 to the development chamber 44. Referring to FIG. 5, the toner delivery hole 34 is has a long and narrow rectangular shape. Designated by a referential code 37*a* are the top and bottom fringe portions of the toner delivery hole 37, which are perpendicular to the direction in which the toner T is advanced into the development chamber 44. Next, referring to FIG. 6, until the cartridge 2 is put to use for the first time, the toner delivery hole 37 remains sealed with a toner seal, which is thermally and removably bonded to the fringe portions 37*a* of the toner delivery hole 37 to keep hole 37 sealed. Thus, if the cartridge 2 is brand-new, a user is to pull out the toner seal 27 to open the toner delivery hole 37.

The toner seal 27 is pasted to the fringe portions 37*a* of the toner delivery hole 37, which face the development chamber 44 (developing portion), as described above. As for the method for attaching the toner seal 27 to the fringe portions 37*a*, any method may be employed as fits. As the user pulls out the toner seal 27, the toner delivery hole 37 becomes open, allowing the toner T in the toner chamber 45, to be delivered to the development chamber 44 so that the toner T comes into contact with the development roller 41.

In practical terms, the toner delivery hole 37 is rectangular. That is, in some cases, because of the errors which occur during the manufacturing of the cartridge 2, the hole 37 may not be perfectly rectangular; all four corners may not be properly angled (by 90°), or may be rounded.

Next, referring to FIG. 6, the development unit 40 has the toner storage container 40*a*, lid 40*b*, first lateral member 55L, second lateral member 55R, development roller 41, and development blade 42. It also has the components for supplying the development roller 41 with electricity, additional sealing members for preventing toner leakage, etc.

The development blade 42 is attached, along with a pair of cleaning members 38, to the toner storage container 40*a*, by its lengthwise ends, with the use of a pair of screws 59. The cleaning members 38 are disposed in contact with the lengthwise end portions of the peripheral surface of the development roller 41, one for one, and clean the portions of the peripheral surface of the development roller 41, with which they are in contact.

Further, a development roller assembly 39 is fitted into a predetermined position of the development unit 40. Incidentally, the development roller assembly 39 has a magnetic roller 41*a*, which was inserted into the development roller 41 through the opening with which one of the lengthwise ends of the development roller 41 is provided. The development roller assembly 39 is also provided with a development roller flange 41*b*, which is solidly attached to the abovementioned lengthwise end of the development roller assembly 39 by being pressed into the abovementioned hole.

The lengthwise end portions of the development roller 41 are fitted with a pair of gap maintaining member 48 (48L and 48R), one for one, which are for maintain a preset amount of distance between the peripheral surface of the drum 20 and that of the development roller 41. The lengthwise end portions of the development roller 41 are also fitted with a pair of bearing members 47 (47L and 47R), one for one.

Further, one of the lengthwise ends of the development roller 41 is fitted with a development roller gear 49. The gear 49 is in mesh with a gear 151*c* (FIG. 4), with which the flange 151 attached to the corresponding lengthwise end of the drum 20. The gear 49 transmits rotational force to the development roller 41. The gear 49 is also in mesh with the abovementioned gear 30.

Further, the development unit 40 has the first and second lateral members 55L and 55R, which are firmly attached to the second and first lengthwise ends, respectively, of the toner storage container 40*a*. The bearing members 47 (47L and 47R) are precisely positioned by the lateral members 55L and 55R. The development roller 41 is rotatably supported by the bearing members 47. Incidentally, the bearing members 47 (47L and 47R) make up the left and right lengthwise end portions of the development roller assembly 39, respectively.

(Toner Conveying Mechanism)

Figure 7:
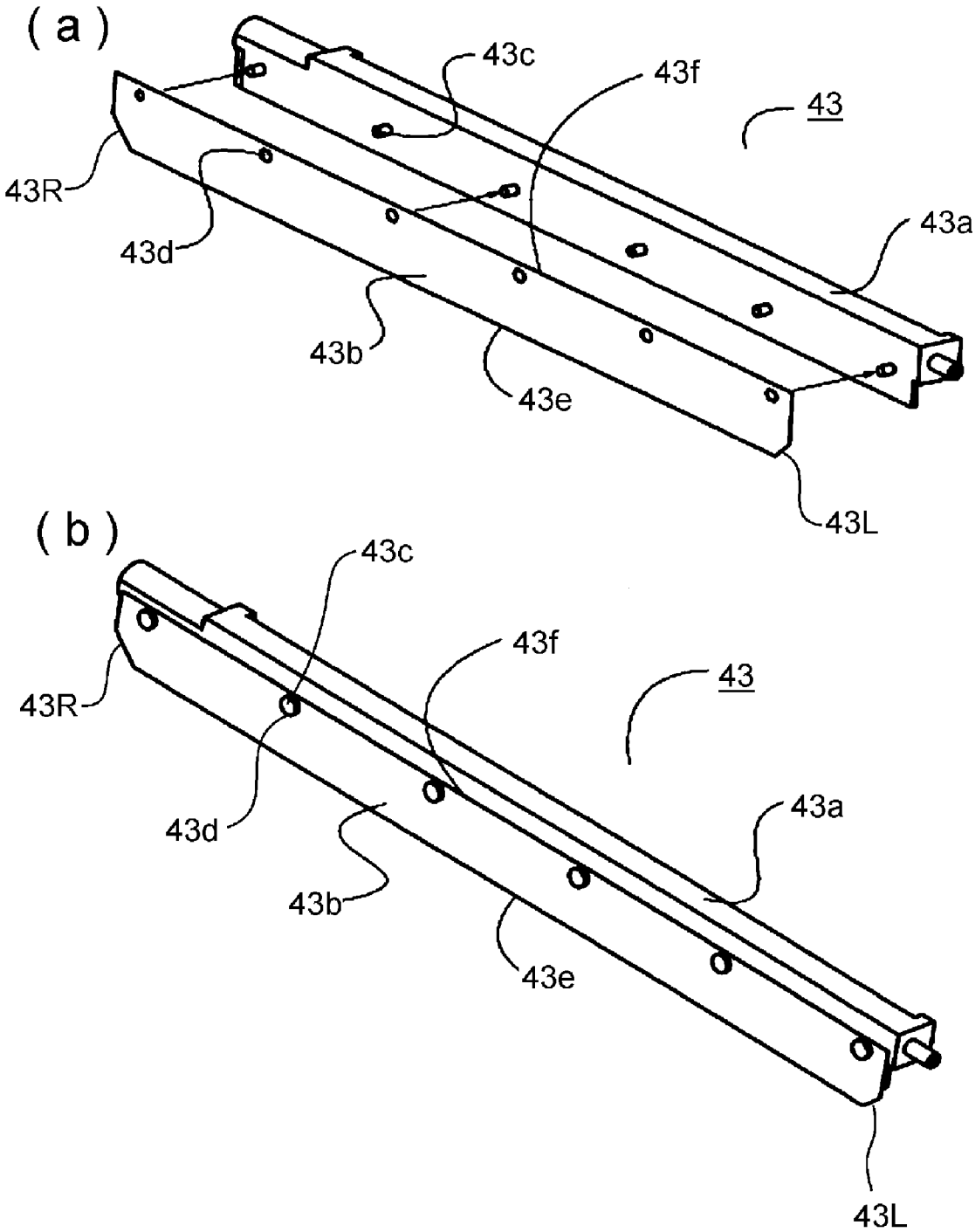
FIG. 7 is a perspective view of the stirring member, which is for showing the structure of the stirring member.
Figure 8:
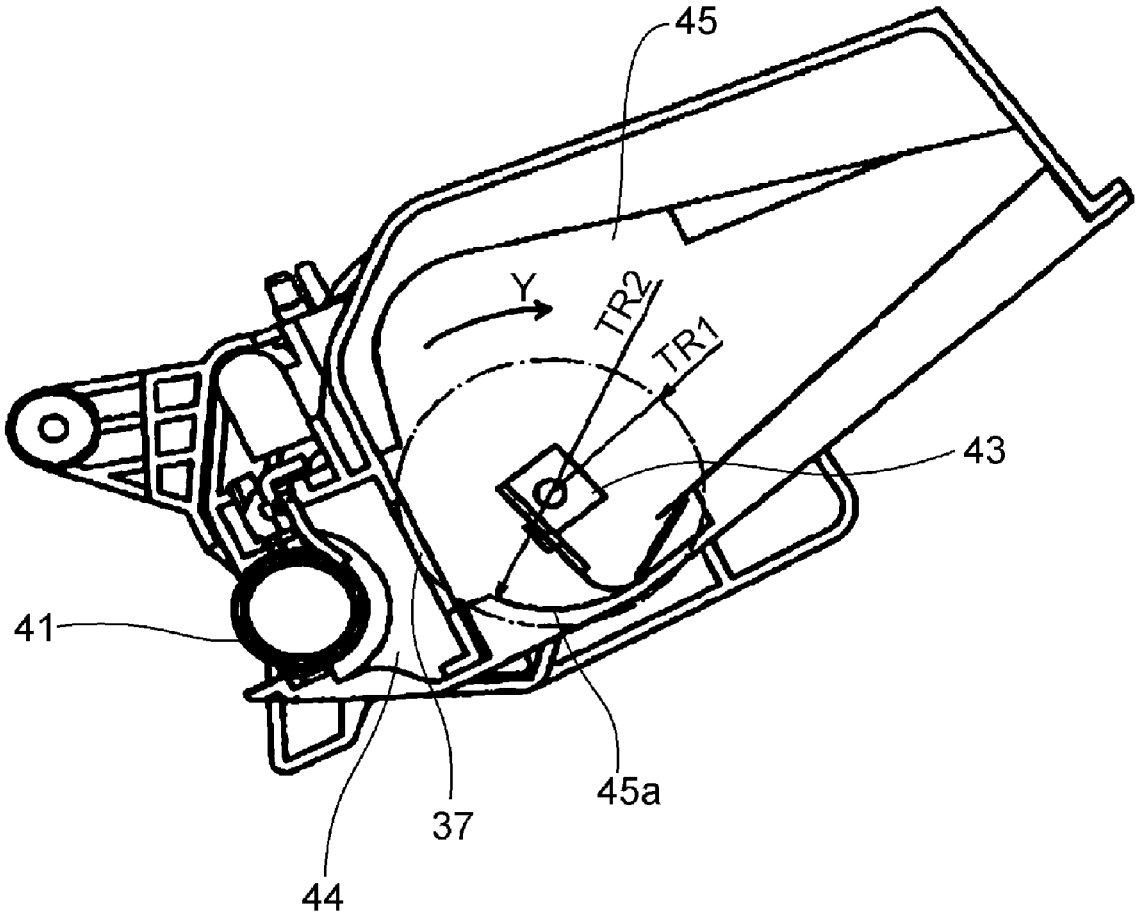
FIG. 8 is a sectional view of the development unit after the installation of the stirring member into the development unit.
Figure 9:
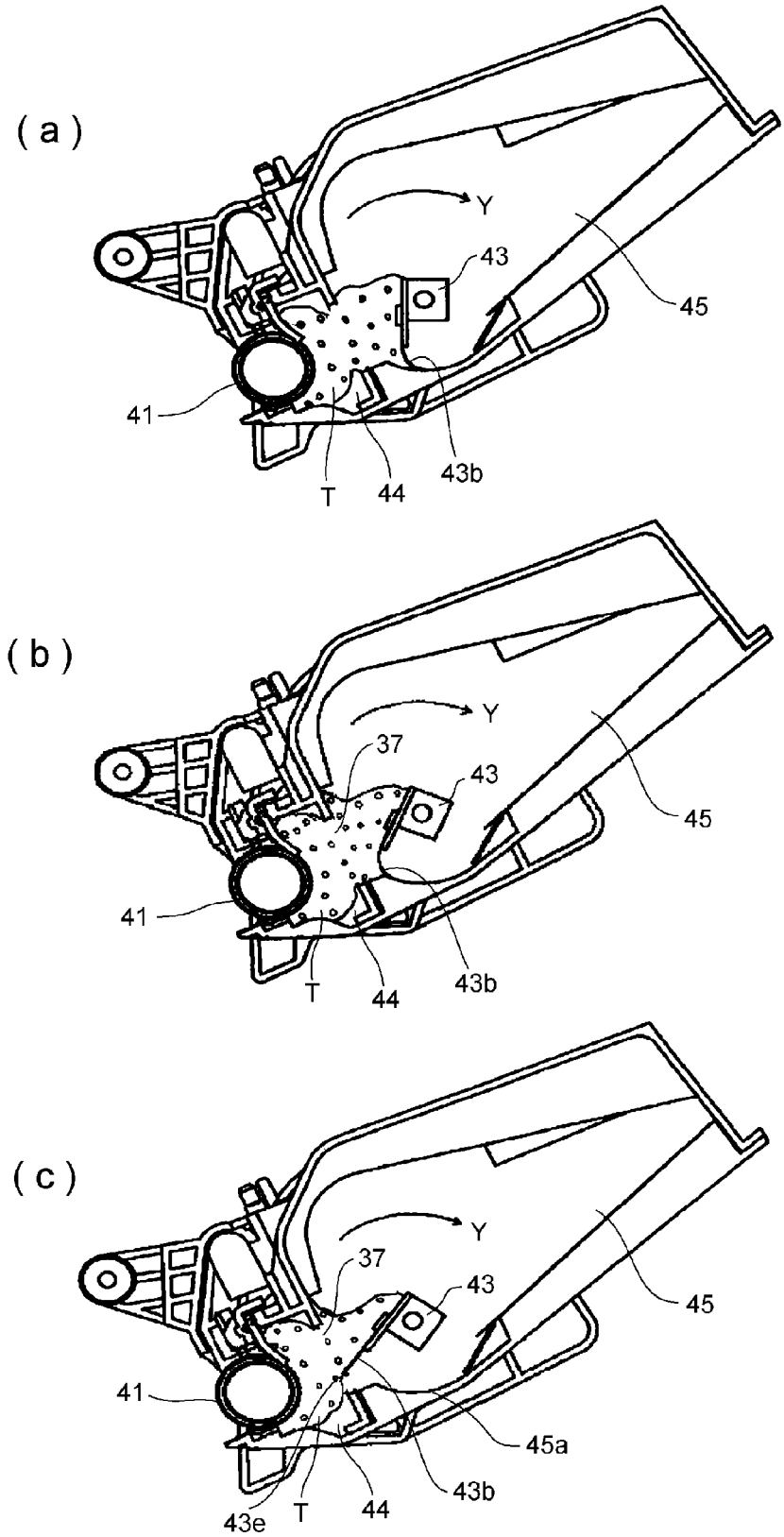
FIGS. 9(*a*)-9(*c*) are sectional views of the development unit, which are for describing the stirring member movement and circulatory movement of the toner in the development unit.
Figure 10:
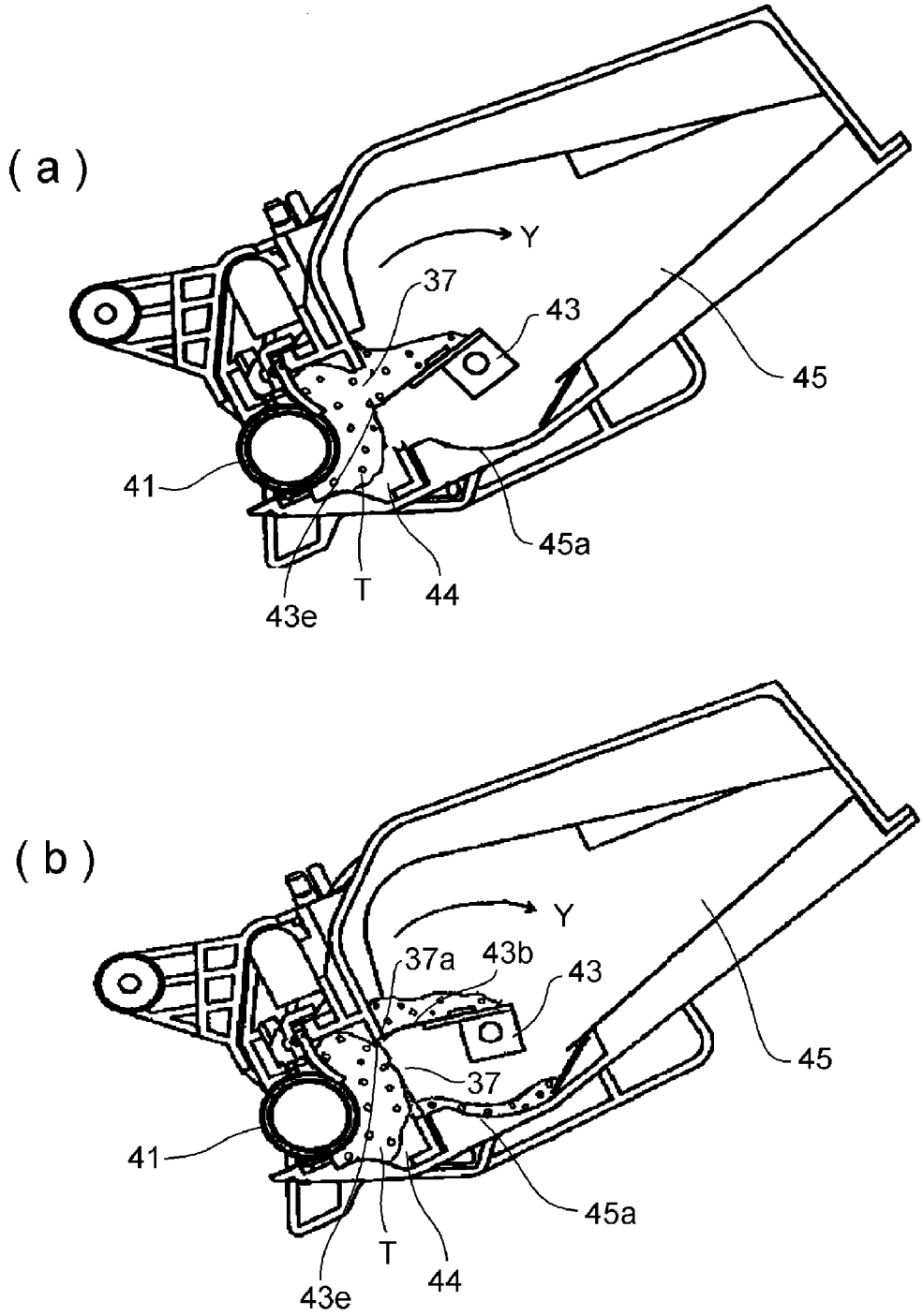
FIGS. 10(*a*) and 10(*b*) are also sectional views of the development unit, which are for describing the stirring member movement and circulatory movement of the toner in the development unit.
Figure 11:
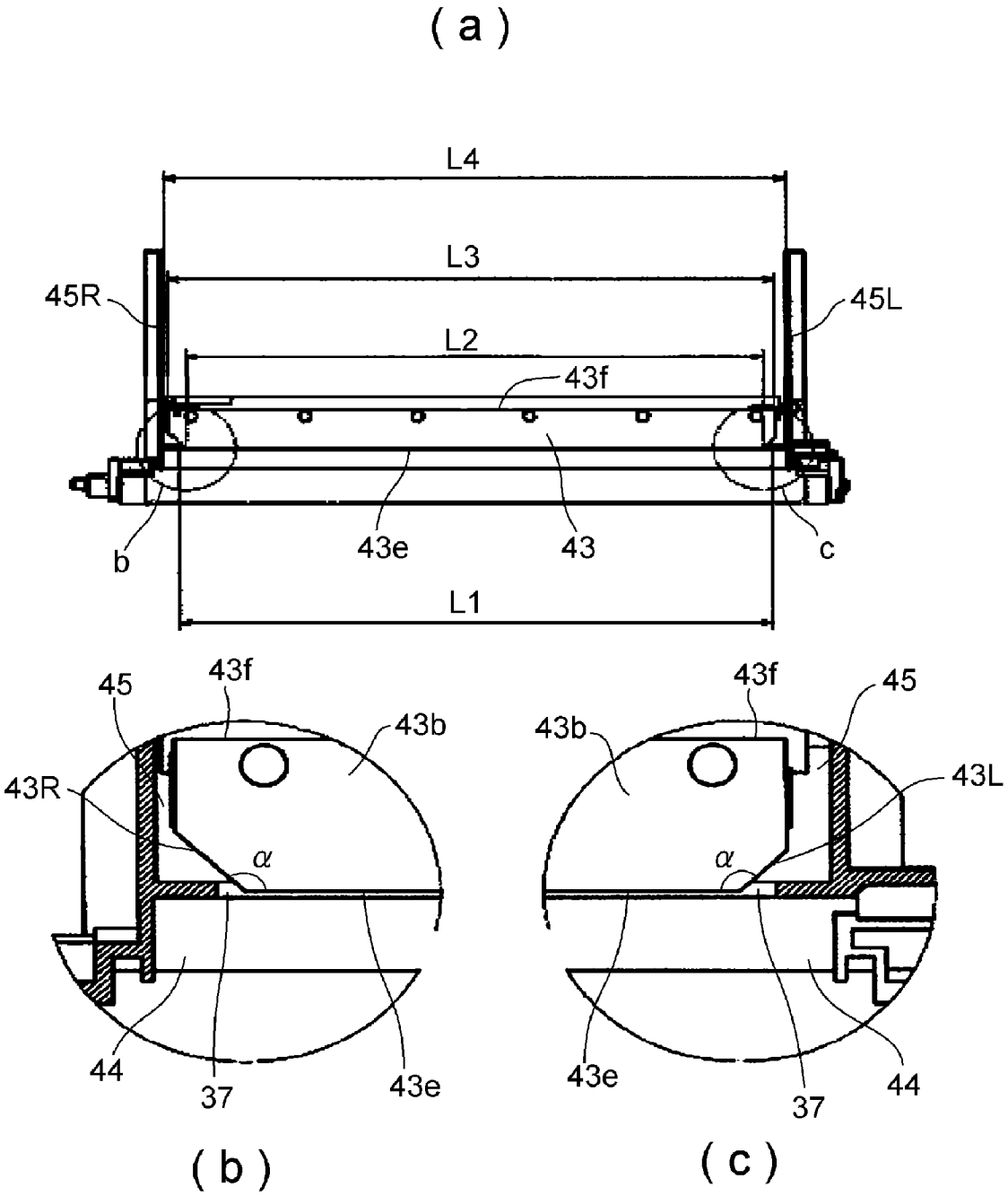
FIGS. 11(*a*), 11(*b*), and 11(*c*) are horizontal sectional views of the development unit, left end portion of the stirring member and its adjacencies, and right end portion of the stirring member and its adjacencies, respectively, which are for showing the positional relationship between the stirring member and the developer delivery hole, in terms of the lengthwise direction of the stirring member.
Figure 12:
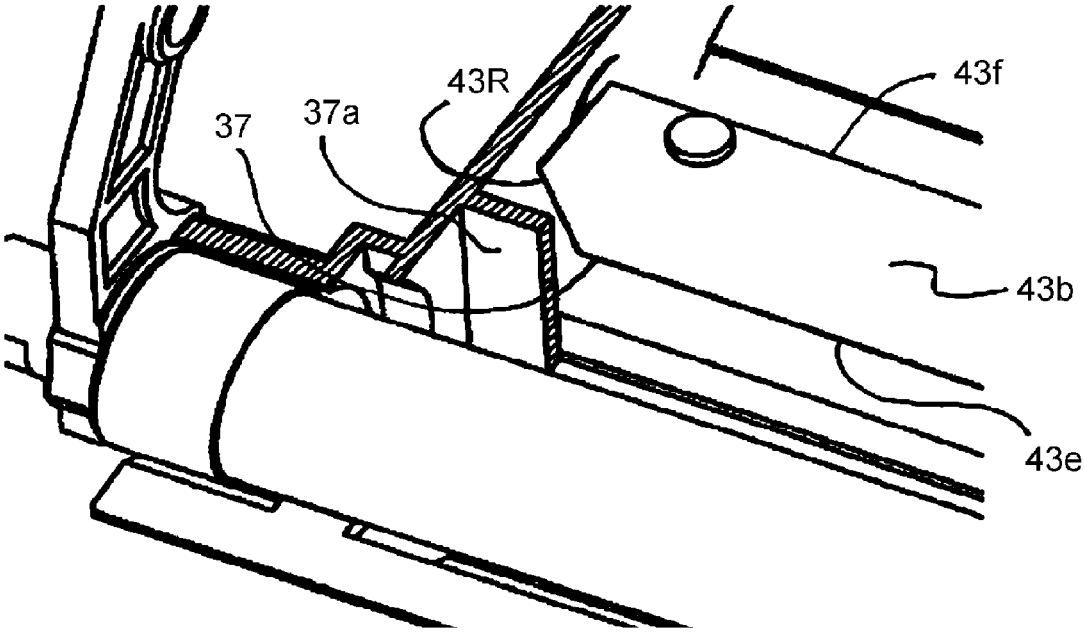
FIG. 12 is a perspective view of the lengthwise right end portion of the stirring member, and its adjacencies, which is for showing the shape of the lengthwise end portion of the stirring member.
Figure 13:
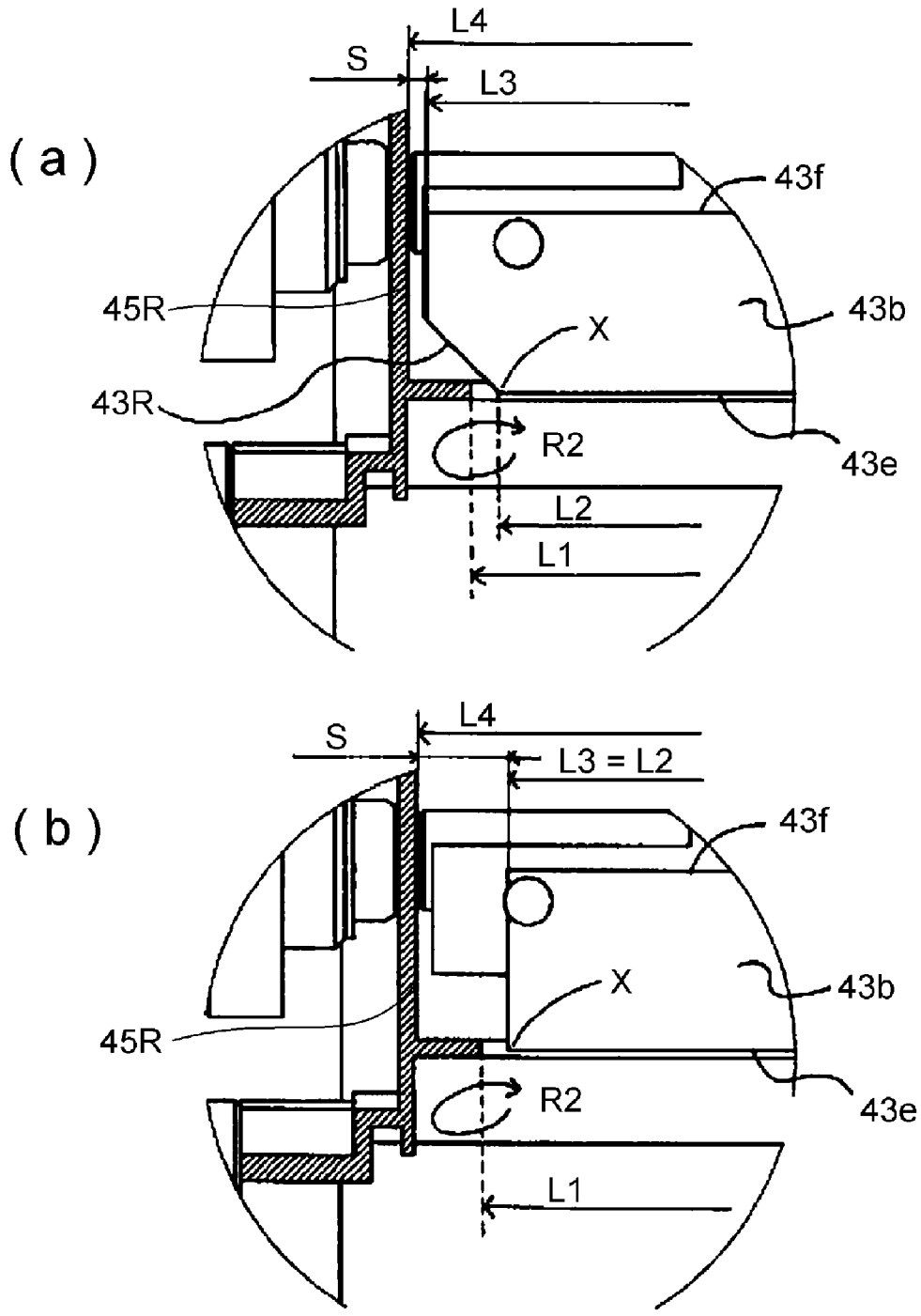
FIGS. 13(*a*) and 13(*b*) are horizontal sectional views of one of the modified versions of the development unit in the preferred embodiment, right end portion of its stirring member, and its adjacencies, respectively, which are for showing the positional relationship between the stirring member, and its developer delivery hole, which are for showing the positional relationship between the stirring member and the toner delivery hole, in terms of the lengthwise direction of the stirring member.

Next, referring to FIGS. 7-13, the toner conveying mechanism, with which the development unit 40 is provided, will be described. FIGS. 7(*a*) and 7(*b*) are perspective views of the stirring member 43, and show the structure of the stirring member 43. FIG. 8 is a sectional view of the development unit 40 after the proper attachment of the stirring member 43 to the unit 40. FIGS. 9(*a*)-9(*c*), and FIGS. 10(*a*) and 10(*b*), are sectional views of the unit 40, which are for describing the movement of the stirring member 43, and the circulatory movement of the toner T. FIGS. 11(*a*) and 11(*b*) are sectional views of the stirring member 43 and its adjacencies, and show the positional relationship between the stirring member 43 and toner delivery hole 37, in terms of their lengthwise direction. FIG. 12 is a perspective view of one of the lengthwise end portion of the stirring member 43, and its adjacencies, and shows the shape of the lengthwise end portion. FIGS. 13(*a*) and 13(*b*) are sectional views of one of the lengthwise end portions of the modified version of the stirring member 43 in the preferred embodiment, which is different in shape from the one in the preferred embodiment. They show the positional relationship between the modified version of the stirring member 43 and the toner delivery hole 37, in terms of their lengthwise direction.

First, referring to FIGS. 7(*a*), 7(*b*), and 8, the toner conveying mechanism will be described regarding its structure.

Referring to FIG. 7(*a*), the stirring member 43 has a supporting portion 43*a* and a stirring portion 43*a*. The supporting portion 43*a* is rotatably supported in the toner chamber 45 by the wall of the toner chamber 45. The stirring portion 43*b* is attached to the supporting portion 43*a*. Designated by a referential code 43*f* is one of the lengthwise edges of the stirring portion 43*b*, by which the stirring portion 43*b* is attached to the supporting portion 43*a*. This edge hereafter will be referred to as the attachment edge 43*f*. Designated by a referential code 43*e* is the opposite lengthwise edge of the stirring portion 43*b* from the attachment edge 43*f*. Further, the supporting portion 43*a* is provided with multiple projections 43*c*, which are aligned in the direction parallel to the lengthwise direction of the supporting portion 43*a*, with the provision of present intervals, whereas the attachment portion 43*f* is provided with multiple holes 43*d*, which are also aligned in the direction parallel to the lengthwise direction of the stirring member 43, with the presence of preset intervals equal to those of the supporting portion 43*a*. Thus, the stirring portion 43*b* is firmly attached to the supporting portion 43*a* by positioning the stirring portion 43*b* relative to the supporting portion 43*a*, in such a manner that the projection 43*c* fit into the holes 43*d*, one for one, and then, melting the projections with the application of heat to prevent the projections from coming out of the holes 43*d* (FIG. 7(*b*)).

The stirring portion 43*b* is an elastic and resilient sheet, being therefore capable of flexing when it is conveying the toner, as will be described later in more detail. In this embodiment, a sheet made of polyphenyl sulfide (PPS), which is 50 μm in thickness, is used as the material for the stirring portion 43*b*. It should be noted here that the material for the stirring portion 43*b* does not need to be limited to a sheet of PPS. For example, a sheet of polyethylene-terephthalate (PET) or the like can be used to obtain the same effects as those obtained by the sheet of PPS.

Next, referring to FIG. 8, the stirring member 43 is located next to the toner delivery hole 37 of the toner chamber 45. It is rotated in the direction indicated by an arrow mark Y, by the rotation of the stirring gear 38 (FIG. 6). As it is rotated, it stirs the toner T (unshown) in the toner chamber 45.

The stirring member 43 conveys the toner T in the toner chamber 45, from the toner chamber 45 to the development chamber 45, in which the development roller 41 is located, while stirring the toner T.

The bottom surface 45*a* of the toner chamber 45 is provided with a curvature, the center of which coincides with the rotational center of the stirring member 43. The radius TR2 of this bottom surface 45*a* is smaller than the radius TR1 of the locus of the sweeping edge 43*e* (conveying edge, stirring edge) (FIG. 7) of the stirring portion 43*b* when the stirring portion 43*b* is straight. Thus, when the stirring portion 43*b* conveys the body of toner T through the portion of the toner chamber, which is next to the curved portion of the bottom surface of the toner chamber 45, it resiliently bends.

Next, referring to FIGS. 9(*a*)-9(*c*), 10(*a*) and 10(*b*), the operation of the toner conveying mechanism will be described. FIGS. 9(*a*)-9(*c*) show the state, in which the toner T and stirring member 43 are, when the stirring member 43 is conveying the toner T toward the development chamber 44. FIGS. 10(*a*) and 10(*b*) show the state, in which the toner T and stirring member 43 are, when the stirring member 43 is conveying the toner T in the opposite direction from the development chamber 44.

Referring to FIG. 9(*a*), the stirring portion 43*b* is conveying the toner T from the toner chamber 45 toward the development chamber 44, while being flexed by the bottom surface 45*a* of the toner chamber 45. When the stirring 43 is in the state shown in FIG. 9(*a*), it is conveying the body of toner T, which is between the stirring member 43 and toner chamber 45, in a manner to pushing the body of toner T into the development chamber 44. Incidentally, the lengthwise direction of the toner chamber 45 is parallel to the development roller 41 (cartridge 2).

Next, referring to FIG. 9(*b*), as the abovementioned body of toner T is conveyed to the adjacencies of the development chamber 45, it is moved into the development chamber 44 by the further rotational movement of the stirring portion 43*b* across the toner delivery hole 37.

While the stirring portion 43*b* is moved from its position shown in FIG. 9(*b*) to the position shown in FIG. 9(*c*), the stirring portion 43*b* leaves the arcuate portion of the bottom surface 45*a* of the toner chamber 45. Thus, the stirring portion 43*b*, which was remaining flexed, is allowed to straighten. As a result, the sweeping edges portion (43*e*) enters the development chamber 44 through the toner delivery hole 37. This is how the toner T in the toner chamber 45 is moved into the development chamber 44 through the toner delivery hole 37. Further, it is also by the straightening of the stirring portion 45*b* that the toner T is moved from the toner chamber 45 into the development chamber 44. The lengthwise end portions of the sweeping edge portion (43*e*) are shaped in such a manner that their edges are slanted relative to the lengthwise direction of the stirring member 43; the stirring portion 43*b* has slanted edges 43R and 43L (FIG. 11), as will be described later in more detail. Thus, even after the stirring portion 43*e* straightens after remaining flexed, the sweeping edge portion (43*e*) does not interferes with the lateral edges of the toner delivery hole 37.

Next, referring to FIG. 10(*a*), even after the toner T is conveyed from the toner chamber 45 into the development chamber 44 by the rotation of the stirring portion 43*b* (stirring member 43), the sweeping edge portion (43*e*) of the stirring portion 43*b* remains extending into the development chamber 44 through the toner delivery hole 37. Therefore, even after the stirring member 43 begins to rotate in the direction to return from the development chamber 44 to the toner chamber 44, the sweeping edge portion (43*e*) is still in the development chamber 44. Thus, as the stirring member 43 rotates in the direction to return to the toner chamber 45, the body of toner T, which is in the adjacent portion of the development chamber 44 to the toner delivery hole 37, can be moved back into the toner chamber 45 (developer storage portion).

Next, referring to FIG. 10(*b*), while the stirring member 37 is rotated in the direction to cause the stirring portion 43*b* to move from the development chamber 44 back into the toner chamber 45, the sweeping edge portion (43*e*) of the stirring portion 43*b* remains in contact with the lengthwise edge 37*a*1 (top edge of toner delivery hole 37) of the top portion of the fringe portion 37*a* of the toner delivery hole 37, being thereby flexed again (as shown in FIG. 10(*b*)). More specifically, the edge 37*a*1 of the top portion of the fringe portion 37*a* is the lengthwise edge of the toner delivery hole 37, which is on the top side of the hole 37 when the cartridge 7 is in its image forming position in the apparatus main assembly 1.

As the stirring member 43 further rotates, the sweeping edge portion (43*e*) of its stirring portion 43*b* leaves the lengthwise edge 37*a*1 of the toner delivery hole 37. As the sweeping edge 43*e* leaves the lengthwise edge 37*a*1, the stirring portion 37*b* is allowed to straighten, causing the toner T having adhered to the stirring portion 43*b*, to be return into the toner chamber 45. That is, not only is the toner T on the stirring portion 43*b* conveyed back into the toner chamber 45 by the rotation of the stirring member 43*b* (stirring member 43), but also, by the resiliency of the stirring portion 43*b*, which causes the stirring portion 43*b* to snappingly straighten back into its natural shape (shape before it is flexed). Therefore, it is ensured that the body of toner T on the stirring portion 43*b* is moved back into the toner chamber 45.

Thus, the toner T in the development unit 40 is satisfactorily moved in a circulatory manner, from the toner chamber 45 to the development chamber 44, and then, from the development chamber 44 to the toner chamber 45, and then, from the toner chamber 45 to the development chamber 44, and so on.

If the toner T is moved only by the rotational movement of the stirring portion 43*b*, which is shown in FIGS. 9(*a*), 9(*b*), and 9(*c*), it is possible that the development chamber 44 will be excessively supplied with the toner T. If the development chamber 44 is excessively supplied with the toner T, some of the toner T in the development chamber 44 is likely to become stagnant in the portion of the development chamber 44 (space in development chamber 44) surrounded by the gap maintaining member 48L, which is located at one (left end) of the lengthwise ends of the development chamber 44, and the fringe portion 37*a* of the toner delivery hole 37, and also, in the portion of the development chamber 44 (space in development chamber 44) surrounded by the gap maintaining member 48R, which is located at the other (right end) lengthwise end of the development chamber 44, and the fringe portion 37*a* of the toner delivery hole 37 (FIG. 6). Here, "excessively supplied with the toner T" means that the amount of the toner T moved into the development chamber 44 by the rotation of the stirring portion 43*b* (stirring member 43) exceeds the normal (proper) amount of the toner T, which is to be present in the development chamber 44 in order to properly develop a latent image.

As the development chamber 44 is supplied with an excessive amount of toner T, a substantial amount of toner T in the development chamber 44 becomes stagnant, that is, the toner T in the development chamber 44 has no place to go in the development chamber 45, and therefore, it accumulates in the radius direction of the development roller 41, in the adjacencies of the gap maintaining members 48L and 48R, which are at the lengthwise left and right ends of the development roller 41.

In this embodiment, therefore, the toner returning operation, that is, the operation for returning the body of toner T having been conveyed into the development chamber 44 is partially returned from the development chamber 44 to the toner chamber 45, which will be described next, is carried out (FIGS. 10(*a*) and 10(*b*)). This embodiment makes it possible to efficiently convey the toner T backward, as will be described later. That is, it makes it possible to efficiently convey the toner T, in a circulatory manner, from the toner chamber 45 to the development chamber 44, and then, from the development chamber 44 to the toner chamber 45, and the, from the toner chamber 45 to the development chamber 44, and so on.

Further, referring to FIGS. 11 and 12, the return conveyance of the toner T, that is, the conveyance of the toner T from the development chamber 44 to the toner chamber 44, will be described in detail. FIG. 11(*b*) is an enlarged view of the lengthwise right end portion of the stirring member 43 and its adjacencies, shown in FIG. 11(*b*), and FIG. 11(*c*) is an enlarged view of the lengthwise left end portion of the stirring member 43 and its adjacencies, shown in FIG. 11(*a*). In the following portion of the description of this embodiment, "width" means the distance (length) from one lengthwise end of a given component to the other lengthwise end of the same component. Further, the abovementioned "lengthwise directions" means the direction parallel to the lengthwise directions of the toner delivery hole 37, stirring portion 43*b*, development chamber 44, and toner chamber 45, and therefore, are parallel to each other.

FIG. 11 is a drawing for showing the relationship among: the width L4 of the toner chamber 45; width L3 of the attachment edge portion 43*f* of the stirring portion 43*b*, by which the stirring portion 43*b* is attached to the supporting portion 43*a*; the width L2 of the other lengthwise edge 43*e* of the stirring portion 43*b*; and width L1 of the toner delivery hole 37.

The comparison of these portions of the development unit 40 reveals the following. The width L4 of the toner chamber 45 is greater than the width L1 of the toner delivery hole 37 and the width L3 of the lengthwise edge 43*f*. Further, the width L3 of the lengthwise edge 43*f* is greater than the width L1 of the hole 37, and the width L2 of the sweeping edge 43*e* is less than the width L1 of the hole 37. That is, L4>L3>L1>L2. The width L2 of the sweeping edge 43*e* of the stirring portion 43*b* is less than the width L1 of the hole 37. Further, the stirring member 43 is positioned so that its stirring portion 43*b* can extends by a preset length into the development chamber 44 through the hole 37. Thus, as the stirring member 43 is rotated, the sweeping edge portion (43*e*) enters from the toner chamber 45 into the development chamber 44 through the hole 37. Referring to FIG. 11, designated by referential codes 45R and 45L are the inward surface of the right lateral wall of the toner chamber 45, and the inward surface of the left lateral wall of the toner chamber 45, respectively.

Next, referring to FIGS. 11 and 12, the lengthwise end portions of the sweeping edge 43*e* are shaped so that it has a first slanted edge 43R and a second slanted edge 43L, which slant toward the supporting portion 43*a*. To describe in more detail, referring to FIGS. 11(*b*) and 12, one of the lengthwise end portions, that is, one of the corner portions, of the sweeping edge portion (43*e*), is shaped in such a manner that the resultant edge 43R is slanted toward the supporting portion 43*a*. Further, referring to FIG. 11(*c*), the other lengthwise end portion, that is, the other corner portion, of the sweeping edge portion (43*e*) is shaped in such a manner that the resultant 43L is also slanted toward the supporting portion 43*a*.

The lengthwise edge portion (43*e*), that is, the sweeping edge portion, of the stirring portion 43*b*, and the lengthwise edge portion (43*f*) of the stirring portion 43*b*, by which the stirring portion 43*b* is attached to the supporting portion 43*a*, are parallel to each other. Further, the widthwise edges of the stirring portion 43*e* are practically parallel to each other. The expression "practically parallel" is used because they may not be perfectly parallel to each other due to the errors which occurred during the manufacturing of the process cartridge 2.

The width L2 of the sweeping edge 43*e* is less than the width L1 of the toner delivery hole 37. Thus, when the stirring member 43 is rotated, the first and second slanted edges 43R and 43L do not come into contact with the lateral edges 37*a* and 37*b* of the hole 37, respectively (no contact). That is, when the stirring member 43 is conveying the toner T from the toner chamber 45 into the development chamber 44, it can enter (extend) into the development chamber 44 through the toner delivery hole 37 without coming into contact with the lateral edges of the hole 37.

In this embodiment, L1 is roughly 205 mm, and L2 is roughly 200 mm. L3 is roughly 210 mm, and L4 is roughly 215 mm. Further, the angle $\alpha$ of the first edge 43R relative to the sweeping edge 34*e*, and the angle $\alpha$ of the second edge 43L relative to the sweeping edge 34*e*, are roughly 135 degrees (FIG. 11).

However, these values are not intended to limit the present invention in scope. That is, the size of each of the abovementioned components, and the angle of each of the abovementioned portions, have only to be selected as fit.

According to the preferred embodiment described above, the stirring member 43 has: the supporting portion 43*a* rotatably disposed in the toner chamber 45 (developer storage portion); and stirring portion 43*g* attached to the supporting portion 43*a* in such a manner that its lengthwise direction become parallel to that of the supporting member 43*a*. The edge portion (43*f*) of the stirring portion 43*b*, by which the stirring portion 43*b* is attached to the supporting portion 43*a*, is greater in length than the toner delivery hole 37. Further, the sweeping edge 43*e* of the stirring portion 43*b* is less in length than the toner delivery hole 37. Further, when the stirring portion 43*b* is moving in the direction to convey the toner T into the development chamber 44, the sweeping edge portion (43*e*) of the stirring portion 43*b* snappingly extends into the development chamber 44 through the toner delivery hole 37 to convey the toner T (developer) from the toner chamber 45 (developer storage portion) into the development chamber 44 (developing station) through the hole 37, whereas when the stirring portion 43*b* is moving toward the toner chamber 45 (developer storage portion), the sweeping edge portion (43*e*) partially conveys back into the toner chamber 45, the body of toner T which it moved into the development chamber 44 through the toner delivery hole 37 by its movement toward the development chamber 44.

That is, according to the preferred embodiment described above, when the stirring portion 43*b* is moving toward the development chamber 44 while the stirring member 43 rotates, the sweeping edge portion (43*e*) of the stirring portion 43 conveys the toner T in the toner chamber 45 (developer storage portion), from the tone chamber 45, into the development chamber 44 (developing portion) through the toner delivery hole 37 by extending into the development chamber 44 through the toner delivery hole 37 (toner supplying movement), whereas when the stirring portion 43*b* is moving toward the toner chamber 45 (developer storage chamber) while the stirring member 43 rotates, the sweeping edge portion (43*e*) partially conveys back into the toner chamber 45 (developer storage chamber), the body of toner T it conveyed into the development chamber 44 through the development delivery hole 37 by its movement toward the development chamber 44 (toner recovery movement). That is, for each full rotation of the stirring member 43, the stirring portion 43*b* of the stirring member 43 conveys the toner T in the toner chamber 45, to the development chamber 44, and also, conveys the toner T in the development chamber 44, to the toner chamber 45. More specifically, according to this preferred embodiment, when the stirring portion 43*b* is rotationally moving from the toner chamber 45 to the toner delivery hole 37, it conveys the toner T in the toner chamber 45, to the development chamber 44, whereas when it is rotationally moving from the development chamber 44 to the toner chamber 45, it conveys the toner T in the development chamber 44, to the toner chamber 45.

Further, the distance between the inward surface of the right lateral wall 45R of the toner chamber 45 and the inward surface of the left lateral wall 45L is greater than the length of the toner delivery hole 37. Further, the toner delivery hole 37 is made slightly shorter than the toner chamber 45 and development chamber 44 to leave a pair of small fringe portions 37*a* at its lengthwise ends, one for one. The small fringes portions 37*a* extend in the direction perpendicular to the direction in which the toner T is advanced into the development chamber 44.

The presence of these fringe portions 37*a* makes it possible to removably attach the toner seal 28 to seal the toner delivery hole 37 in such a manner that it can be removed to reopen the hole 37. As the stirring member 37 further rotates, the sweeping edge portion (43*e*) of the stirring portion 43*b* is flexed, and then, the sweeping edge 43*e* comes into contact with the lengthwise edge 37*a*1 of one of the fringe portions 37*a* of the toner delivery hole 37, across the entirety of the edge 37*a*1. Here, the lengthwise edge 37*a*1 is the lengthwise edge of the toner delivery hole 37, which is on the top side when the cartridge 2 is in its image forming position in the apparatus main assembly 1.

Then, as the sweeping edge 43*e* leaves the lengthwise edge 37*a*1, it allows the stirring portion 43*b* to snappingly straighten. Thus, the toner T on the stirring portion 43*b* is flung back into the toner chamber 43 by this springy straightening of the stirring portion 43*b*, which is caused by the resiliency of the stirring portion 43*b*. Therefore, it is ensured that a part of the body of toner T conveyed into the development chamber 44 is conveyed back into the development chamber 44. In other words, the toner T is satisfactorily moved in the cartridge 2 in a circulatory manner.

Further, the stirring portion 43*b* is shaped so that both of the lengthwise end portions of the sweeping edge portion (43*e*) of the stirring portion 43*b* slant toward the supporting portion 43*a* of the stirring member 43; there are the first and second slanted edges 43R and 43L. It is by the presence of these slanted edges 43R and 43L that the above described effects are obtained.

Further, when the stirring member 43 rotates, the first and second slanted edges 43R and 43L do not come into contact with the edges of the right and left fringe portions 37*a* of the toner delivery hole 37. Therefore, it is ensured that the above-described effects are obtained.

The supporting portion 43*a* of the stirring member 43 is provided with multiple projections 43*c*, which align in the lengthwise direction of the supporting portion 43*a* with the presence of the preset intervals, whereas the attachment portion 43*f* is provided with multiple holes 43*d*, which are also aligned in the direction parallel to the lengthwise direction of the stirring member 43, with the presence of preset intervals. Thus, the stirring portion 43*b* is attached to the supporting portion 43*a* by the following method. That is, the stirring portion 43*b* is positioned relative to the supporting portion 43*a* in such a manner that the projections 43*c* fit into the holes 43*d*, one for one. Then, in order to prevent the projections 43*c* from coming out of the holes 43*d*, the portion of each projection 43*c*, which is extending beyond the stirring portion 43*b*, is made greater in diameter than the corresponding hole 43*d*, by applying heat to the extending portion, and then, cooling it (naturally or forcefully). This is how the stirring portion 43*b* is attached to the supporting portion 43*a*.

That is, the stirring portion 43*b* is attached to the supporting portion 43*a* by thermally melting the projections 43*c* while keeping the projections 43*c* fitted in the holes 43*d*.

In other words, the stirring member 43*b* can be easily attached to the supporting portion 43*a* without using an adhesive.

Further, the development unit 40 has the stirring gear 28 (helical gear), which is located outside one of the lateral wall 45L of the toner chamber 45. The stirring gear 38 rotates with the supporting portion 43*a*. As the stirring gear 28 rotates, it generates a thrust directed toward the other lengthwise end of the supporting portion 43*a*. Thus, while the stirring member 43 is rotated, the supporting portion 43*a* (stirring member 43) is kept pressed toward the other lengthwise end.

Next, referring to FIG. 13, the positional relationship between a stirring member 43, which is different in shape from the stirring member 43 in the above described preferred embodiment of the present invention, and the toner delivery hole 37, will be described. FIG. 13(*a*) is a drawing for showing the positional relationship among the components of the toner conveying mechanism, and their portions, in terms of the lengthwise direction, in the preferred embodiment of the present invention. FIG. 13(*b*) is a drawing for showing the positional relationship among the components of the toner conveying mechanism, and their portions, in terms of the lengthwise direction, in a comparative example of a toner conveying mechanism for a process cartridge.

In the case of the toner conveying mechanism shown in FIG. 13(*a*), there is the following relationship among: the width L4 of the toner chamber 45; width L3 of the edge 43*f* of the attachment edge portion of the stirring portion 43*b*, by which the stirring portion 43*b* is attached to the supporting portion 43*a*; the width L2 of the other lengthwise edge, that is, the sweeping edge 43*e*, of the stirring portion 43*b*; and width L1 of the toner delivery hole 37: L4>L3>L1>L2.

On the other hand, in the case of the toner conveying mechanism shown in FIG. 13(*b*), the relationship among: the width L4 of the toner chamber 45, width L3 of the lengthwise edge 43*f* of the attachment portion of the stirring portion 43*b*, by which the stirring portion 43*b* is attached to the supporting portion 43*a*; the width L2 of the other lengthwise edge, that is, the sweeping edge 43*e*, of the stirring portion 43*b*; and width L1 of the toner delivery hole 37 is: L4>L1>L3=L2. That is, the stirring portion (43*b*) is practically rectangular.

It is evident from the comparison between FIGS. 13(*a*) and 13(*b*) that the shape of the stirring portion 43*b* in FIG. 13(*a*) is such that the stirring portion 43*b* is narrowest at the sweeping edge 43*e*, and widens toward the edge 43*f* of the attachment portion. Thus, the corner portion X of the stirring portion 43*b* in FIG. 13(*a*) is higher in rigidity than the corner portion X of the stirring portion 43*b* in FIG. 13(*b*).

Thus, when the sweeping edge portion (43*e*) bears the weight of the body of toner T, the corner portion X in FIG. 13(*b*) is likely to more easily flex compared to the corner portion X in FIG. 13(*a*), because the corner portion X in FIG. 13(*b*) is lower in rigidity than the corner portion X in FIG. 13(*a*).

Therefore, shaping the stirring portion (43*b*) as shown in FIG. 13(*a*), which shows the stirring portion 43*b* in the preferred embodiment of the present invention, offers the following advantages over shaping the stirring portion (43*b*) as shown in FIG. 13(*b*). That is, in a case where the stirring portion 43*b* is shaped as shown in FIG. 13(*a*) which shows the stirring portion 43*b* in the preferred embodiment, it is ensured that when the stirring portion 43*b* is rotationally moving toward the toner chamber 45, the body of toner T conveyed into the developer chamber 44 is partially conveyed back into the toner chamber 45 by being carried on the sweeping edge portion (43*e*) of the stirring portion 43*a*, which has extended into the development chamber 44 through the toner delivery hole 37 as shown in FIGS. 10(*a*) and 10(*b*). The arrow marks R2 in FIGS. 13(*a*) and 13(*b*) indicate the bodies of toner T, which have become stagnant in the lateral end portions of the development chamber 44.

Further, a stirring portion 43*b* shaped as shown in FIG. 13(*a*), which shows the stirring portion 43*b* in the preferred embodiment of the present invention, is greater in the amount by which the toner T is conveyed from the development chamber 44 to the toner chamber 45 than the stirring portion 43*b* shaped as shown in FIG. 13(*b*).

Regarding the dimensional and positional relationship among the components in the toner chamber 45 and their portions, the smaller the difference between the width L3 of the edge 43*f* of the stirring portion attachment portion and width L4 of the toner chamber 45, the smaller the gap S between the lateral wall 45R of the toner chamber 45 and the corresponding lengthwise end of the stirring portion 43*b*, and the gap S between the lateral wall 45L and the adjacent lengthwise end of the stirring portion 43*b* (FIGS. 13(*a*) and 13(*b*)).

Shaping the stirring portion 43*b* as shown in FIG. 13(*a*) can make the gap S smaller than shaping the stirring portion 43*b* as shown in FIG. 13(*b*).

The narrower the gap S, the closer to the inward surface of the lateral wall 45R of the toner chamber 45 and the inward surface of the lateral wall 45L of the toner chamber 45, the stirring portion 43*b* can stir the toner T, and therefore, the wider the range, in terms of the lengthwise direction of the toner chamber 45, in which the stirring portion 43*b* can convey the toner T while stirring it.

The gap S shown in FIG. 13(*a*) is narrower than that shown in FIG. 13(*b*). Therefore, the stirring portion 43*b* shaped as shown in FIG. 13(*a*) can convey the toner T in a wider range, in terms of the lengthwise direction of the toner chamber 45, while stirring the toner T, than the stirring portion 43*b* shaped as shown in FIG. 13(*b*).

From the standpoint of the efficiency with which the toner T is conveyed in a circulatory manner in the development unit, that is, the toner is conveyed from the toner chamber 45 to the development chamber 44, and then, from the development chamber 44 back into the toner chamber 45, and so on, the shape for the stirring portion 43*b*, which is shown in FIG. 13(*a*), is superior to that shown in FIG. 13(*b*).

Further, the lengths L4, L3, and L2 of the toner chamber 45, stirring portion 43*b*, and toner delivery hole 37, respectively, are set to satisfy the following relationship: L4>L3>L1>L2. This arrangement can further improve the cartridge 2 in terms of the conveyance of the toner T from the toner chamber 45 into the development chamber 44, and then, from the development chamber 44 back into the toner chamber 45; the toner T is more satisfactorily conveyed. That is, according to the preferred embodiment of the present invention, the toner T is efficiently conveyed in a circulatory manner in the cartridge 2, that is, from the toner chamber 45 to the development chamber 44, and then, from the development chamber 44 to the toner chamber 45, and so on.

Also according to the preferred embodiment described above, the toner T in the toner chamber 45 can be stirred across a wider range of the toner chamber 45 in terms of its lengthwise direction. Further, since the toner T in the toner chamber 45 is conveyed from the toner chamber 45 to the development chamber while being stirred across the wider range of the toner chamber 45 in terms of its lengthwise direction, the entire range of the development roller 41 in terms of its lengthwise direction is more uniformly supplied with the toner T. Therefore, it becomes possible to reliably output high quality images, that is, images which are accurate in density across the entire range in terms of the direction parallel to the development roller 41.

Further, the forward toner conveyance, that is, the toner conveyance from the toner chamber to the development chamber, the reverse toner conveyance, that is, the toner conveyance from the development chamber to the toner chamber, can be repeatedly carried out with improved efficiency. The alternate repetition of the forward toner conveyance and reverse toner conveyance can prevent supplying the development chamber with an excessive amount of toner, and also, can reduce the amount by which toner becomes stagnant in the development chamber.

Therefore, it is possible to prevent the following problem: as the development chamber 44 is continuously supplied with an excessive amount of toner, the stagnant toner in the development chamber 44 is robbed by the excessive amount of toner, of the place to go in the development chamber 44, being thereby cornered into the lengthwise end portions of the development chamber 44, and eventually, it accumulates at the lengthwise ends of the development roller 41.

Figure 14:
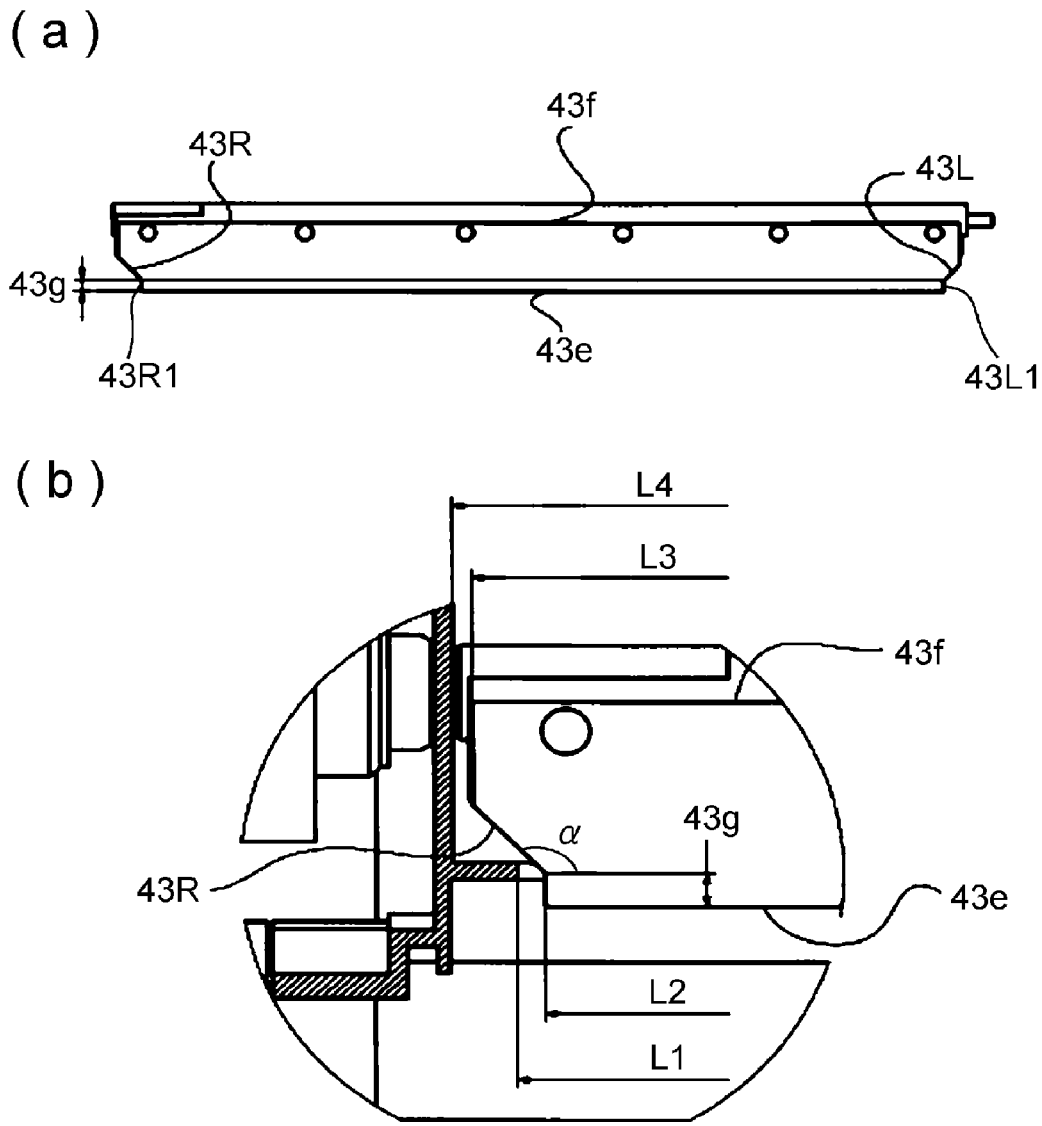
FIGS. 14(*a*) and 14(*b*) are a top plan view of the entirety of the modified version of the stirring member in the preferred embodiment, and an enlarged top view of the right end portion of the stirring member and its adjacencies, respectively, which are for showing the structure of the stirring member.

FIGS. 14(*a*) and 14(*b*) are plan views of the stirring member 43, which are for showing the structure of the stirring member 43.

FIG. 14(*a*) shows the overall shape of another modified version of the stirring member 43 in the preferred embodiment, and FIG. 14(*b*) shows the lengthwise right end portion of the stirring member 43, and its adjacencies, after the installation of the stirring member 43 into the toner chamber 45.

The stirring portion 43*b* shown in FIG. 14(*a*) has a portion 43*g*, which extends beyond the sweeping edge portion (43*e*) of the stirring portion 43*b* shown in FIG. 13(*a*). More specifically, not only is this stirring portion 43*b* shaped in such a manner that the lengthwise right and left end portions of its sweeping edge portion (43*e*) have the abovementioned first and second slanted edges 43R and 43L, respectively, but also, its sweeping edge portion (43*e*) has the portion 43*g*, which extends beyond the line connecting the inward ends of the first and second slanted edges 43R and 43L. Thus, in the case of this stirring portion 43*b*, the sweeping edge 43*e* is the lengthwise edge of the portion 43*g*. That is, in this modification of the preferred embodiment, the sweeping edge portion of the stirring portion 43*b* is shaped so that the portion 43*g*, which is practically a long and narrow rectangular portion, is positioned between the inward end of the first slanted edge 43R, and the inward end of the second slanted edge 43*l*, in terms of the lengthwise direction of the stirring portion 43*b*.

Next, referring to FIG. 14(*b*), the relationship among: the width L4 of the toner chamber 45, width L3 of the lengthwise edge 43*f* of the attachment portion (43*f*) of the stirring portion 43*b*; width L2 of the sweeping edge 43*e*; and width L1 of the toner delivery hole 37 is: L4>L3>L1>L2. That is, it is the same as that in the preferred embodiment. Further, the width L2 of the sweeping edge 43*e* of the stirring portion 43*b* is less than the width L1 of the toner delivery hole 37. Moreover, the stirring member 43 is positioned so that the sweeping edge portion (43*e*) of the stirring portion 43*b* extends farther into the development chamber 44 through the toner delivery hole 37.

When the toner T is conveyed to the development chamber 44, the above described practically rectangular portion 43*g* having the sweeping edge 43*e* does not come into contact with the lateral fringe portions 37*a* of the toner delivery hole 37. Further, when the toner T is conveyed to the development chamber 44, the sweeping edge portion (43*e*) of the stirring portion 43*b* reaches farther into the development chamber 44 through the toner delivery hole 37.

Further, when the toner T is reversely conveyed, the sweeping edge portion (43*e*) of the stirring portion 43*b* can return some of the toner T in the development chamber 44 to the toner chamber 45.

The greater the dimension of the protruding edge portion 43*g* in terms of the direction perpendicular to the lengthwise direction of the stirring member 43, the farther the sweeping edge portion (43*e*) reaches into the development chamber 44, and therefore, the greater the amount by which the toner T in the development chamber 44 is conveyed back into the toner chamber 45 during the reverse toner conveyance.

The dimension of the protruding edge portion 43*g* is set in consideration of the amount by which the toner T is conveyed from the toner chamber 45 to the development chamber 44, and the amount by which the toner T is reversely conveyed, that is, from the development chamber 44 to the toner chamber 45.

According to the above described preferred embodiment of the present invention and its modification, the toner T (developer) in the cartridge 2 can be satisfactorily conveyed in a circulatory manner, that is, from the toner chamber 45 (developer storage portion) to the development chamber 44, and then, from the development chamber 44 to the toner chamber 45, and then, from the toner chamber 45 to the development chamber 44, and so on.

Also, according to the above described preferred embodiment and its modification, not only is it possible to satisfactorily convey the toner T in the toner chamber 45 to the development chamber 44, but also, it is possible to satisfactorily return the toner T in the development chamber 44 to the toner chamber 45.

Also, according to the above described preferred embodiment and its modification, not only is it possible to satisfactorily convey the toner T in the toner chamber 45 deeper into the development chamber 44, but also, satisfactorily convey the toner from the development chamber 44 deeper into the toner chamber 45 than any of cartridges in accordance with the prior art.

Therefore, according to the above described preferred embodiment of the present invention and its modification, the toner T in the toner chamber 45 (cartridge 2) can be stirred across the wider range in terms of the lengthwise direction of the toner chamber 45 than that in any of cartridges in accordance with the prior art. Further, since the toner T in the toner chamber 45 is conveyed from the toner chamber 45 to the development chamber while being stirred across the wider range of the toner chamber 45 in terms of its lengthwise direction, the entire range of the development roller 41 in terms of its lengthwise direction is more uniformly supplied with the toner T. Therefore, it becomes possible to reliably output high quality images, that is, images which are accurate in density across its entire range in terms of the direction parallel to the development roller 41.

Further, the forward toner conveyance, that is, the toner conveyance from the toner chamber 45 into the development chamber 44, and the reverse toner conveyance, that is, the toner conveyance from the development chamber 44 into the toner chamber 45, can be repeatedly carried out in a satisfactory manner. Therefore, the problem that the development chamber 44 is excessively supplied with the toner can be prevented by repeating the forward toner conveyance and reverse toner conveyance. Further, it is possible to minimize the amount by which the toner T becomes stagnant in the development chamber 44.

Therefore, it is possible to prevent the occurrence of the phenomenon that the stagnant toner in the development chamber 44 is cornered into the lengthwise end portions of the development chamber, by the body of toner T, which is successively conveyed into the development chamber 44, and eventually, the stagnant toner T cumulatively collect in the adjacencies of the lengthwise ends of the development roller 41.

In the above described preferred embodiment of the present invention and its modification, the developing apparatus and electrophotographic photosensitive drum were integrally disposed in a cartridge to obtain a process cartridge which is removably mountable in the main assembly of an electrophotographic image forming apparatus. However, this structural arrangement is not intended to limit the present invention in scope. For example, a developing apparatus may be turned into a development cartridge which is removably mountable in the main assembly of an electrophotographic image forming apparatus. In a case where the developing apparatus is in the form of a development cartridge, a so-called process cartridge is made up of an electrophotographic photosensitive drum, and at least one processing means, more specifically, at least one of the cleaning means and charging means, which are integrally disposed in a cartridge. As for the developing apparatus, it may be in the forms of a development cartridge, or may be built in as a part of the main assembly of an electrophotographic image forming apparatus.

Further, the measurements, materials, and shapes of the structural components of the electrophotographic image forming apparatus in the above described preferred embodiment of the present invention and its modified version, and their positional relationship, should be altered as necessary, based on the structure of an apparatus to which the present invention is applied, and/or various factors which affect the operation of the apparatus. That is, the above-described preferred embodiment of the present invention is not intended to limit the present invention in scope, unless specifically noted.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 198425/2008 filed Jul. 31, 2008 which is hereby incorporated by reference.

What is claimed is:

1. A developing device for an electrophotographic image forming apparatus, said developing device comprising:

a developing roller for developing an electrostatic latent image formed on an electrophotographic photosensitive drum;

a developing portion in which said developing roller is provided;

a developer accommodating portion for accommodating the developer to be used for development of the electrostatic latent image by said developing roller;

a supply opening, provided between said developing portion and said developer accommodating portion, for supplying the developer from said developer accommodating portion; and a stirring member including (a) a supporting portion rotatably provided on said developer accommodating portion, and (b) a stirring portion provided on said supporting portion, said stirring portion including a sweeping edge provided at a free end of said stirring portion and extended in a rotational axial direction of said supporting portion, (c) first inclined portion connected to one end of said sweeping edge with respect to the rotational axial direction and inclined relative to said sweeping edge, and (d) a second inclined portion connected to the other end of said sweeping edge with respect to the rotational axial direction and inclined relative to said sweeping edge, wherein said stirring portion has a length measured in a longitudinal direction of a mounting portion mounted to said supporting portion that is longer than a length of said supply opening in the longitudinal direction, and said sweeping edge has a length that is shorter than the length of said supply opening, and wherein when said stirring member is rotated said sweeping edge enters said supply opening by the rotation thereof toward said supply opening.

2. An apparatus according to claim 1, wherein a distance between an inner wall at one longitudinal end portion of the developer accommodating portion and an inner wall at the other longitudinal end portion of the developer accommodating portion is longer than the length of said supply opening in the longitudinal direction, and wherein said supply opening is provided with an opening edge surrounding said supply opening and extending in a direction crossing an entering direction of the developer at one and the other longitudinal ends of said supply opening and perpendicular to the longitudinal direction of said supply opening.

3. An apparatus according to claim 2, wherein said free end of said stirring portion bends with rotation of said stirring member to elastically contact one end portion of the opening edge of said supply opening and is away therefrom.

4. An apparatus according to claim 1, wherein said first inclined portion and said second inclined portion are inclined relative to said sweeping edge so as to not contact one or the other end portion, with respect to the rotational axial direction, of an edge of said supply opening.

5. An apparatus according to claim 1, wherein said supporting portion of said stirring member is provided with spaced apart projections that are spaced apart in the longitudinal direction, wherein said mounting portion is provided with spaced apart holes that are spaced apart in the longitudinal direction, and wherein said stirring portion is mounted to said supporting portion by fusing said projections to said mounting portion when said projections engaged with said holes.

6. An apparatus according to claim 1, further comprising a helical gear integrally rotatable with said supporting portion outside of one end portion of said developer accommodating portion, wherein, when said helical gear is rotated, a thrust force is produced in a direction from one lengthwise end portion toward the other lengthwise end portion of said supporting portion to urge said supporting portion toward said other lengthwise end portion of said supporting portion in the longitudinal direction.

7. An apparatus according to claim 1, wherein said developing device comprises a developing cartridge detachably mountable to a main assembly of the electrophotographic image forming apparatus.

8. An apparatus according to claim 1, wherein said developing device is a process cartridge together with said electrophotographic photosensitive drum, and wherein said process cartridge is detachably mountable to a main assembly of the electrophotographic image forming apparatus.

9. An apparatus according to claim 7 or 8, further comprising a developer seal for unsealably sealing said supply opening at a developing portion side of an opening edge of said supply opening, wherein said developer seal is manually removable.

10. An electrophotographic image forming apparatus comprising:

i) a process cartridge detachably mountable to said apparatus and including:

an electrophotographic photosensitive drum, a developing roller for developing an electrostatic latent image formed on said electrophotographic photosensitive drum;

a developing portion in which said developing roller is provided;

a developer accommodating portion for accommodating the developer to be used for development of the electrostatic latent image by said developing roller;

a supply opening, provided between said developing portion and said developer accommodating portion, for supplying the developer from said developer accommodating portion; and a stirring member including (a) a supporting portion rotatably provided on said developer accommodating portion, and (b) a stirring portion provided on said supporting portion, said stirring portion including a sweeping edge provided at a free end of said stirring portion and extended in a rotational axial direction of said supporting portion, (c) first inclined portion connected to one end of said sweeping edge with respect to the rotational axial direction and inclined relative to said sweeping edge, and (d) a second inclined portion connected to other end of said sweeping edge with respect to the rotational axial direction and inclined relative to said sweeping edge, wherein said stirring portion has a length measured in a longitudinal direction of a mounting portion mounted to said supporting portion that is longer than a length of said supply opening in the longitudinal direction, and said sweeping edge has a length that is shorter than the length of said supply opening, and wherein when said stirring member is rotated said sweeping edge enters said supply opening by rotation thereof toward said supply opening;

ii) a transfer roller for transferring a developed image formed on said electrophotographic photosensitive drum onto a recording material; and iii) a feeding device for feeding the recording material.

11. An apparatus according to claim 10, wherein a distance between an inner wall at one longitudinal end portion of the developer accommodating portion and an inner wall at the other longitudinal end portion of the developer accommodating portion is longer than the length of said supply opening in the longitudinal direction, and wherein said supply opening is provided with an opening edge surrounding said supply opening and extending in a direction crossing an entering direction of the developer at one and the other longitudinal ends of said supply opening and perpendicular to the longitudinal direction of said supply opening.

12. An apparatus according to claim 11, wherein said free end of said stirring portion bends with rotation of said stirring member to elastically contact one end portion of the opening edge of said supply opening and is away therefrom.

13. An apparatus according to claim 10, wherein said first inclined portion and said second inclined portion are inclined relative to said sweeping edge so as to not contact one or the other end portion, with respect to the rotational axial direction, of an edge of said supply opening.

14. An apparatus according to claim 10, wherein said supporting portion of said stirring member is provided with spaced apart projections that are spaced apart in the longitudinal direction, wherein said mounting portion is provided with spaced apart holes that are spaced apart in the longitudinal direction, and wherein said stirring portion is mounted to said supporting portion by fusing said projections to said mounting portion with said projections engaged with said holes.

15. An apparatus according to claim 10, further comprising a helical gear integrally rotatable with said supporting portion outside of one end portion of said developer accommodating portion, wherein, when said helical gear is rotated, a thrust force is produced in a direction from one lengthwise end portion toward the other lengthwise end portion of said supporting portion to urge said supporting portion toward said other lengthwise end portion of said supporting portion in the longitudinal direction.

* * * * *